US008264414B2

(12) United States Patent
Sakata et al.

(10) Patent No.: US 8,264,414 B2
(45) Date of Patent: Sep. 11, 2012

(54) ANTENNA APPARATUS INCLUDING MULTIPLE ANTENNA PORTIONS ON ONE ANTENNA ELEMENT

(75) Inventors: Tsutomu Sakata, Osaka (JP); Atsushi Yamamoto, Kyoto (JP); Hiroshi Iwai, Osaka (JP); Satoru Amari, Osaka (JP)

(73) Assignee: Panasonic Corporation, Osaka (JP)

( * ) Notice: Subject to any disclaimer, the term of this patent is extended or adjusted under 35 U.S.C. 154(b) by 426 days.

(21) Appl. No.: 12/665,456

(22) PCT Filed: Apr. 21, 2009

(86) PCT No.: PCT/JP2009/001814
§ 371 (c)(1),
(2), (4) Date: Feb. 12, 2010

(87) PCT Pub. No.: WO2009/130887
PCT Pub. Date: Oct. 29, 2009

(65) Prior Publication Data

US 2010/0207823 A1 Aug. 19, 2010

(30) Foreign Application Priority Data

Apr. 21, 2008 (JP) ..... 2008-110215

(51) Int. Cl.
*H01Q 1/24* (2006.01)

(52) U.S. Cl. ..... 343/702

(58) Field of Classification Search ..... 343/702, 343/722, 860, 709
See application file for complete search history.

(56) References Cited

U.S. PATENT DOCUMENTS

| | | | | |
|---|---|---|---|---|
| 6,759,991 | B2 | 7/2004 | Boyle | |
| 6,836,248 | B2 * | 12/2004 | Fukushima et al. | 343/700 MS |
| 7,038,631 | B2 * | 5/2006 | Jecko et al. | 343/767 |
| 7,443,344 | B2 * | 10/2008 | Boyle | 343/700 MS |
| 7,460,069 | B2 * | 12/2008 | Park et al. | 343/700 MS |
| 7,777,688 | B2 * | 8/2010 | Tani et al. | 343/852 |
| 2002/0126052 | A1 | 9/2002 | Boyle | |
| 2007/0115181 | A1 | 5/2007 | Park et al. | |

FOREIGN PATENT DOCUMENTS

| | | |
|---|---|---|
| JP | 2004-32303 | 1/2004 |
| JP | 2004-519914 | 7/2004 |
| JP | 2007-151115 | 6/2007 |
| JP | 2007-282124 | 10/2007 |
| WO | 02/071535 | 9/2002 |
| WO | 02/075853 | 9/2002 |

OTHER PUBLICATIONS

International Search Report issued Aug. 4, 2009 in International (PCT) Application No. PCT/JP2009/001814.
International Preliminary Report on Patentability issued Dec. 29, 2010 in International (PCT) Application No. PCT/JP2009/001814.

* cited by examiner

*Primary Examiner* — Huedung Mancuso
(74) *Attorney, Agent, or Firm* — Wenderoth, Lind & Ponack, L.L.P.

(57) ABSTRACT

An antenna apparatus is provided with two feed ports respectively provided at positions on an antenna element, and the antenna element is simultaneously excited through the two feed ports so as to simultaneously operate as two antenna portions respectively associated with the two feed ports. The antenna apparatus is further provided with a slit provided between the two feed ports, for changing a resonant frequency of the antenna element and producing isolation between the feed ports at a isolation frequency, and provided with matching means for shifting an operating frequency of the antenna element from the changed resonant frequency to the isolation frequency.

9 Claims, 33 Drawing Sheets

ANTENNA APPARATUS INCLUDING MULTIPLE ANTENNA PORTIONS ON ONE ANTENNA ELEMENT

TECHNICAL FIELD

The present invention mainly relates to an antenna apparatus for use in mobile communications such as mobile phones, and a wireless communication apparatus provided with the antenna apparatus.

BACKGROUND ART

The size and thickness of portable wireless communication apparatuses, such as mobile phones, have been rapidly reduced. Portable wireless communication apparatuses have been transformed from apparatuses to be used only as conventional telephones, to data terminals for transmitting and receiving electronic mails and for browsing web pages of WWW (World Wide Web), etc. Further, since the amount of information to be handled has increased from that of conventional audio and text information to that of pictures and videos, a further improvement in communication quality is required. In addition, portable wireless communication apparatuses are required to handle various applications, including telephone call for voices, data communication for browsing web pages, watching of television broadcasts, etc. In such circumstances, an antenna apparatus operable over a wide frequency range is required for wireless communications of the respective applications.

As conventional antenna apparatuses capable of adjusting a resonant frequency while covering a wide frequency band, there are, e.g., an antenna apparatus of Patent Literature 1, in which an antenna element portion is provided with a slit to adjust a resonant frequency, and a notch antenna of Patent Literature 2, in which a slit is provided with a trap circuit.

The antenna apparatus of Patent Literature 1 is configured including a planar radiating element (radiating plate), and a ground plate facing the planar radiating element in parallel, and further including a feeding portion located at about the center of an edge of the radiating plate for supplying high-frequency signals, a short-circuiting portion for short-circuiting the radiating plate and the ground plate near the feeding portion, and two resonators formed by providing a slit in the edge of the radiating plate substantially opposed to the feeding portion. The degree of coupling between the two resonators is optimized by adjusting the shape or dimensions of the slit, or by loading a reactance element or conductor plate on the slit. Thus, a small and low-profile antenna can be obtained with suitable characteristics.

The notch antenna of Patent Literature 2 can open the slit at the position of the trap circuit for radio frequency signals when requiring resonance in a low frequency band for communication, and on the other hand, can close the slit at the position of the trap circuit for radio frequency signals when requiring resonance in a high frequency band for communication. Thus, the resonant length of the notch antenna can be appropriately changed according to the frequency band to resonate for communication.

CITATION LIST

Patent Literature

PATENT LITERATURE 1: PCT International Publication WO2002/075853.

PATENT LITERATURE 2: Japanese Patent laid-open Publication No. 2004-032303.

SUMMARY OF INVENTION

Technical Problem

Recently, antenna apparatuses using MIMO (Multi-Input Multi-Output) technique for transmitting and/or receiving radio signals of multiple channels simultaneously through space division multiplexing have appeared in order to achieve high-speed communication with increased communication capacity. An antenna apparatus using MIMO communication needs to simultaneously transmit and/or receive multiple radio signals with low correlation to each other, by using different directivities, polarization characteristics, or the like, in order to achieve space division multiplexing.

Although the configurations of Patent Literatures 1 and 2 can change a resonant frequency, they have only one feeding portion, thus, there is a problem that they can not be used for MIMO communications, diversity communications, and adaptive arrays.

An object of the present invention is therefore to solve the above-described problem, and to provide an antenna apparatus capable of simultaneously transmitting and/or receiving multiple radio signals with low correlation to each other, with a simple configuration, and to provide a wireless communication apparatus provided with such an antenna apparatus.

Solution to Problem

An antenna apparatus according to the first aspect of the present invention is provided with a first and a second feed ports respectively provided at positions on an antenna element, and the antenna element is simultaneously excited through the first and the second feed ports so as to simultaneously operate as a first and a second antenna portions respectively associated with the first and the second feed ports. The antenna apparatus is further provided with: electromagnetic coupling adjustment means provided between the first and the second feed ports, the electromagnetic coupling adjustment means changing a resonant frequency of the antenna element and producing isolation between the first and the second feed ports at a isolation frequency; and impedance matching means for shifting an operating frequency of the antenna element from the changed resonant frequency to the isolation frequency.

In the antenna apparatus, the electromagnetic coupling adjustment means is at least one slit provided on the antenna element.

Moreover, the antenna apparatus is configured as a dipole antenna including a first antenna element and a second antenna element. The first feed port is provided at a first position where the first antenna elements is opposed to the second antenna elements. The second feed port is provided at a second position which is different from the first position and where the first antenna elements is opposed to the second antenna elements. The electromagnetic coupling adjustment means is at least one slit provided on at least one of the first and the second antenna elements.

Further, the antenna apparatus is further provided with a trap circuit provided at a position along one of the slits, with a distance from an opening of the slit. The trap circuit is open and makes the entire slit resonate at a first frequency, and the trap circuit makes only a section of the slit from the opening to the trap circuit resonate at frequencies deviated from the first frequency.

Furthermore, the antenna apparatus is further provided with a reactance element provided on at least one of the slits, the reactance element changing the resonant frequency and the isolation frequency.

Moreover, the antenna apparatus is further provided with: a variable reactance element provided on at least one of the slits; and control means for changing a reactance value of the variable reactance element to change the resonant frequency and the isolation frequency.

Further, in the antenna apparatus, the electromagnetic coupling adjustment means is at least one slot provided on the antenna element.

Furthermore, in the antenna apparatus, the antenna element is configured as a planar inverted-F antenna element on a ground conductor.

A wireless communication apparatus according to the second aspect of the present invention transmits and receives multiple radio signals, and the wireless communication apparatus is provided with the antenna apparatus according to the first aspect of the present invention.

Advantageous Effects of Invention

As described above, according to the antenna apparatus and the wireless communication apparatus using the antenna apparatus according to the present invention, it is possible to achieve a MIMO antenna apparatus capable of resonating the antenna element at a certain operating frequency as well as ensuring high isolation between the feed ports, thus operating with low coupling. The antenna element with the plurality of feed ports is further provided with the slit, thus changing the resonant frequency of the antenna element. The slit results in high isolation between the two feed ports.

For the purpose of communication using the plurality of feed ports simultaneously, it is necessary to resonate the antenna at a certain operating frequency, and to achieve high isolation between the feed ports. The antenna apparatus and the wireless communication apparatus provided with the antenna apparatus according to the present invention are configured including the matching circuits connected to the respective feed ports, for adjusting the resonant frequency, and the frequency at which isolation is high, to the same frequency. According to the present invention, it is possible to adjust the operating frequency of the antenna element and to achieve high isolation between the two feed ports at the operating frequency, and therefore, it is possible to provide the wireless communication apparatus capable of transmitting and/or receiving multiple radio signals simultaneously.

According to the present invention, while using only one antenna elements, it is possible to operate the antenna element as multiple antenna portions, and also ensure isolation between the multiple antenna portions. By ensuring isolation and low coupling between multiple antenna portions of the MIMO antenna apparatus, it is possible to use the respective antenna portions for simultaneously transmitting and/or receiving multiple radio signals with low correlation to each other. In addition, it is possible to adjust the operating frequency of the antenna element, thus supporting applications at different frequencies.

DESCRIPTION OF EMBODIMENTS

Figure 1:
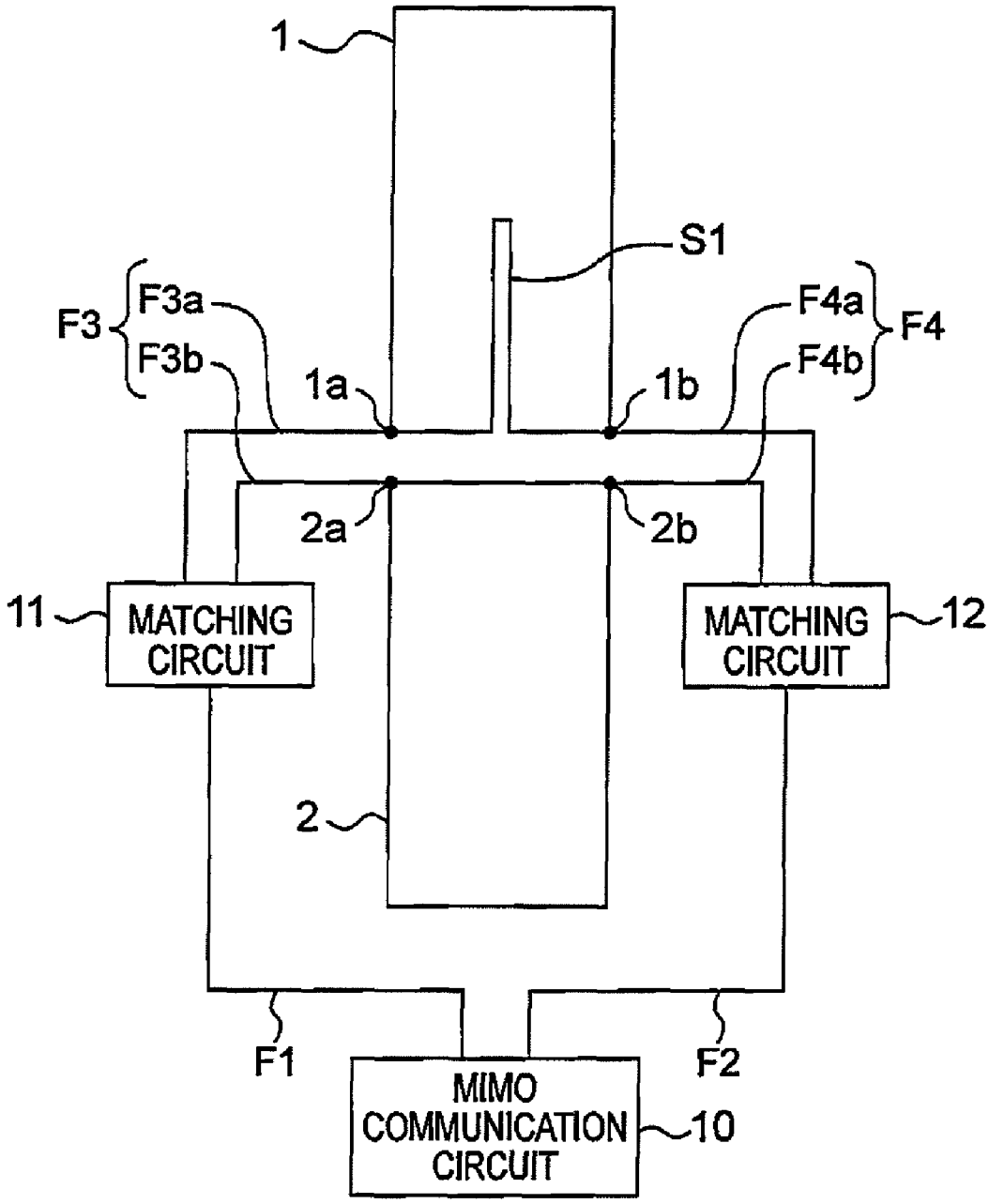
FIG. 1 is a block diagram showing a schematic configuration of an antenna apparatus according to a first preferred embodiment of the present invention.

Preferred embodiments according to the present invention will be described below with reference to the drawings. Note that similar components are denoted by the same reference numerals.

First Preferred Embodiment

FIG. 1 is a block diagram showing a schematic configuration of an antenna apparatus according to a first preferred embodiment of the present invention. The antenna apparatus of the present preferred embodiment includes a rectangular antenna element 1 having two distinct feed points 1*a* and 1*b*, and the single antenna element 1 operates as two antenna portions by exciting the antenna element 1 through the feed point 1*a* as a first antenna portion, and simultaneously, exciting the antenna element 1 through the feed point 1*b* as a second antenna portion.

Normally, if a single antenna element is provided with a plurality of feed ports (or feed points), then isolation between the feed ports can not be ensured, thus increasing electromagnetic coupling between individual antenna portions, and increasing correlation between signals. Therefore, for example, upon reception, the identical received signal is outputted from each feed port. In such a case, good characteristics for diversity or MIMO can not be obtained.

The antenna apparatus of the present preferred embodiment is characterized by including a slit S1 between the feed points 1*a* and 1*b* of the antenna element 1, and characterized by, through the length of the slit S1, adjusting the resonant frequency of the antenna element 1, and further adjusting a frequency at which isolation can be ensured between the feed points 1*a* and 1*b*.

Referring to FIG. 1, the antenna apparatus includes the antenna element 1 and a ground conductor 2, each made of a rectangular conductive plate. The antenna element 1 and the ground conductor 2 are spaced apart from each other by a certain distance, such that one side of the antenna element 1 is opposed to one side of the ground conductor 2. Feed ports are provided respectively at both ends of the pair of opposing sides of the antenna element 1 and the ground conductor 2. One feed port includes the feed point 1*a* provided on the antenna element 1 at one end of the side opposed to the ground conductor 2 (in FIG. 1, a lower left end of the antenna element 1), and includes a connection point 2*a* provided on the ground conductor 2 at one end of the side opposed to the antenna element 1 (in FIG. 1, an upper left end of the ground conductor 2). The other feed port includes the feed point 1*b* provided on the antenna element 1 at the other end of the side opposed to the ground conductor 2 (in FIG. 1, a lower right end of the antenna element 1), and includes a connection point 2*b* provided on the ground conductor 2 at the other end of the side opposed to the antenna element 1 (in FIG. 1, an upper right end of the ground conductor 2). The antenna element 1 is further provided with the slit S1 between the two feed ports, i.e., between the feed points 1*a* and 1*b*, for adjusting electromagnetic coupling between the antenna portions and ensuring certain isolation between the feed ports. The slit S1 has a certain width and a certain length, and one end of the slit S1 is configured as an open end, with an opening on the side between the feed points 1*a* and 1*b*. The feed point 1*a* and the connection point 2*a* are connected to an impedance matching circuit 11 (hereinafter, referred to as "matching circuit 11") through signal lines F3*a* and F3*b* (hereinafter, collectively referred to as "feed line F3"). The matching circuit 11 is connected to a MIMO communication circuit 10 through a feed line F1. Similarly, the feed point 1*b* and the connection point 2*b* are connected to an impedance matching circuit 12 (hereinafter, referred to as "matching circuit 12") through signal lines F4*a* and F4*b* (hereinafter, collectively referred to as "feed line F4"). The matching circuit 12 is connected to the MIMO communication circuit 10 through a feed line F2. Each of the feed lines F1 and F2 is made of, e.g., a coaxial cable with a characteristic impedance of 50Ω. Similarly, each of the feed lines F3 and F4 is made of, e.g., a coaxial cable with a characteristic impedance of 50Ω, and in this case, the signal lines F3*a* and F4*a* as inner conductors of the coaxial cables connect the antenna element 1 to the matching circuits 11 and 12, respectively, and the signal lines F3*b* and F4*b* as outer conductors of the coaxial cables connect the ground conductor 2 to the matching circuits 11 and 12, respectively. Alternatively, each of the feed lines F3 and F4 may be made of a balanced feed line. The MIMO communication circuit 10 transmits and receives radio signals of multiple channels of a MIMO communication scheme (in the present preferred embodiment, two channels) through the antenna element 1. The present preferred embodiment is configured as described above, and accordingly, the antenna element 1 is excited as a first antenna portion through one feed port (i.e., the feed point 1*a*), and simultaneously excited as a second antenna portion through the other feed port (i.e., the feed point 1*b*), thus operating the single antenna element 1 as two antenna portions.

Effects of providing the antenna element 1 with the slit S1 are as follows. Providing the slit S1 decreases the resonant frequency of the antenna element 1 itself. Furthermore, as will be described later with reference to FIGS. 10A, 10B, and 11, the slit S1 operates as a resonator according to the length of the slit S1. Since the slit S1 is electromagnetically coupled to the antenna element 1 itself, the resonant frequency of the antenna element 1 changes according to a frequency of resonance conditions of the slit S1, as compared to the case without the slit S1. Providing the slit S1 can change the resonant frequency of the antenna element 1, and increase isolation between the feed ports at a certain frequency. In general, a frequency at which high isolation can be ensured by providing the slit S1 (hereinafter, referred to as "isolation frequency") is not identical to the resonant frequency of the antenna element 1. Therefore, in the present preferred embodiment, the matching circuits 11 and 12 are provided between the feed ports and the MIMO communication circuit 10, in order to shift the operating frequency of the antenna element 1 (i.e., a frequency at which a desired signal is transmitted and received) from the resonant frequency changed by the slit S1, to the isolation frequency. At a terminal of the matching circuit 11 on the side of the MIMO communication circuit 10 (i.e., a terminal on the side connected to the feed line F1), an impedance seen from the terminal to the antenna element 1 matches an impedance seen from the terminal to the MIMO communication circuit 10 (i.e., a characteristic impedance of 50Ω of the feed line F1). Similarly, at a terminal of the matching circuit 12 on the side of the MIMO communication circuit 10 (i.e., a terminal on the side connected to the feed line F2), an impedance seen from the terminal to the antenna element 1 matches an impedance seen from the terminal to the MIMO communication circuit 10 (i.e., a characteristic impedance of 50Ω of the feed line F2). Providing the matching circuits 11 and 12 affects both the resonant frequency and the isolation frequency, but mainly contributes to changing the resonant frequency. The present preferred embodiment is configured as described above, and accordingly, can resonate the antenna element 1 at a desired operating frequency and ensure high isolation between the feed ports, thus achieving a MIMO antenna apparatus operable with low coupling.

As described above, the antenna apparatus of the present preferred embodiment can operate the single antenna element 1 as two antenna portions, while ensuring isolation between the feed ports with a simple configuration, and transmit and/or receive multiple radio signals simultaneously.

In the case in which the ground conductor 2 is of a similar size to that of the antenna element 1 as illustrated in FIG. 1, the antenna apparatus can be regarded as a dipole antenna made of the antenna element 1 and the ground conductor 2. The ground conductor 2 is excited as a third antenna portion through one feed port (i.e., the connection point 2*a*), and simultaneously excited as a fourth antenna portion through the other feed port (i.e., the connection point 2*b*), thus operating also the ground conductor 2 as two antenna portions. In this case, since an image (mirror image) of the slit S1 is formed on the ground conductor 2, it is possible to ensure isolation between the feed ports for the third and fourth antenna portions, too. With the above-described configuration, it is possible to excite the first and third antenna portions as a first dipole antenna portion through one feed port, and simultaneously, excite the second and fourth antenna portions as a second dipole antenna portion through the other feed port, thus operating a single dipole antenna (i.e., the antenna element 1 and the ground conductor 2) as two dipole antenna portions. Thus, the antenna apparatus of the present preferred embodiment can operate the single dipole antenna as two dipole antenna portions, while ensuring isolation between the feed ports with a simple configuration, and transmit and/or receive multiple radio signals simultaneously.

Second Preferred Embodiment

Figure 2:
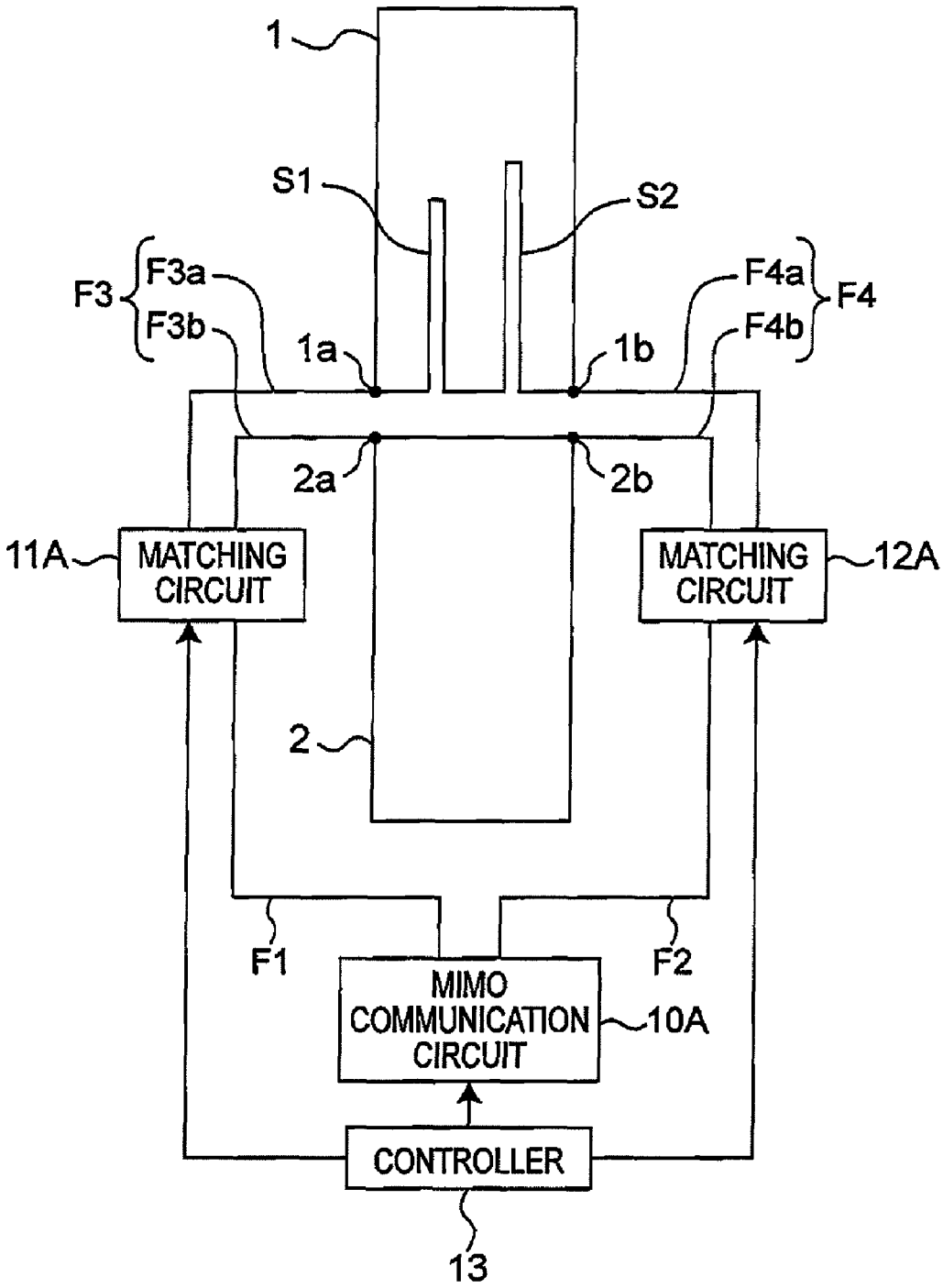
FIG. 2 is a block diagram showing a schematic configuration of an antenna apparatus according to a second preferred embodiment of the present invention.

FIG. 2 is a block diagram showing a schematic configuration of an antenna apparatus according to a second preferred embodiment of the present invention. The antenna apparatus of the present preferred embodiment is characterized by including a plurality of different slits S1 and S2 for ensuring isolation at a plurality of different frequencies.

Referring to FIG. 2, the antenna apparatus of the present preferred embodiment has the configuration of FIG. 1, and further has the slit S2 on an antenna element 1 between two feed ports, i.e., between feed points 1*a* and 1*b*, for adjusting electromagnetic coupling and ensuring certain isolation between the feed ports. The slit S2 has a certain width and a certain length, and one end of the slit S2 is configured as an open end, with an opening on a side between the feed points 1*a* and 1*b*, as in the case of the slit S1. However, the slit S2 is configured with, e.g., a different length from that of the slit S1, so as to resonate the antenna element 1 at a different frequency from a resonant frequency of the antenna element 1 that results from providing the slit S1, and ensure isolation between the feed ports at a different frequency from that of the slit S1. In the present preferred embodiment, the two slits S1 and S2 are provided between the feed ports, thus achieving two different isolation frequencies. In addition, the antenna apparatus of the present preferred embodiment is provided with matching circuits 11A and 12A and a MIMO communication circuit 10A capable of adjusting their operating frequencies, instead of the matching circuits 11 and 12 and the MIMO communication circuit 10 of the first preferred embodiment, and further provided with a controller 13 for adjusting the operating frequencies. The controller 13 adjusts the operating frequencies of the matching circuits 11A and 12A, and thus, selectively shifts the operating frequency of the antenna element 1 to one of the two isolation frequencies.

Thus, the present preferred embodiment is provided with the plurality of slits S1 and S2 having different lengths, thus achieving different resonant frequencies and achieving different isolation frequencies. In other words, since the slits S1 and S2 are electromagnetically coupled to the antenna element 1 at different frequencies, the antenna element 1 has a plurality of resonant frequencies, and also has a plurality of isolation frequencies. Thus, the antenna apparatus can operate at a plurality of frequencies by selectively shifting the operating frequency of the antenna element 1 to one of the isolation frequencies.

As described above, the antenna apparatus of the present preferred embodiment can operate the single antenna element 1 as two antenna portions, while ensuring isolation between the feed ports at a plurality of isolation frequencies with a simple configuration, and transmit and/or receive multiple radio signals simultaneously.

Third Preferred Embodiment

Figure 3:
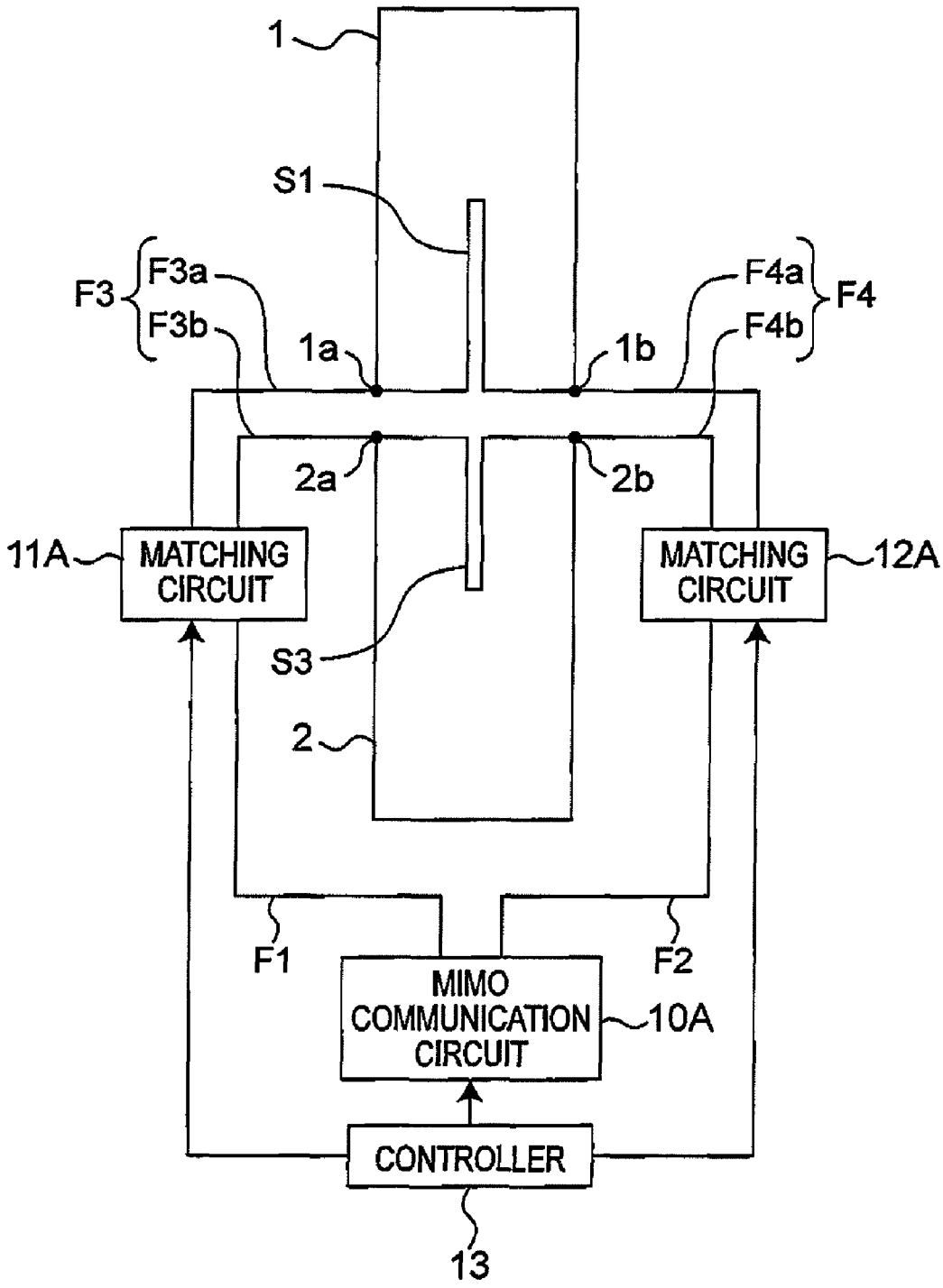
FIG. 3 is a block diagram showing a schematic configuration of an antenna apparatus according to a third preferred embodiment of the present invention.

FIG. 3 is a block diagram showing a schematic configuration of an antenna apparatus according to a third preferred embodiment of the present invention. The antenna apparatus of the present preferred embodiment is characterized by including a slit S3 on a ground conductor 2, in addition to a slit S1 on an antenna element 1. In the first preferred embodiment, the slit S1 is provided on the antenna element 1. As described above, the antenna apparatus operates as a dipole antenna when the ground conductor 2 is of a similar size to that of the antenna element 1, and accordingly, it is possible to obtain the same frequency adjustment effect even when further providing a slit on the ground conductor 2.

Referring to FIG. 3, the antenna element 1 has the slit S1 between feed points 1*a* and 1*b*, as in the case of the first preferred embodiment. The ground conductor 2 also has the slit S3 between two feed ports, i.e., between connection points 2*a* and 2*b*, for adjusting electromagnetic coupling and ensuring certain isolation between the feed ports. The slit S3 has a certain width and a certain length, and one end of the slit S3 is configured as an open end, with an opening on a side between the connection points 2*a* and 2*b*. The slit S3 is preferably configured with, e.g., a different length from the length of the slit S1, so as to resonate the antenna element 1 and the ground conductor 2 at a different frequency from a resonant frequency of the antenna element 1 and the ground conductor 2 that results from providing the slit S1, and ensure isolation between the feed ports at a different frequency from that of the slit S1. In the present preferred embodiment, the two slits S1 and S3 are provided between the feed ports, thus achieving two different isolation frequencies. Each of feed lines F3 and F4 is made of a balanced feed line. Further, as in the case of the second preferred embodiment, the antenna apparatus of the present preferred embodiment is provided with matching circuits 11A and 12A and a MIMO communication circuit 10A capable of adjusting their operating frequencies, and a controller 13 for adjusting the operating frequencies. The controller 13 adjusts the operating frequencies of the matching circuits 11A and 12A, and thus, selectively shifts the operating frequency of the antenna element 1 and the ground conductor 2 to one of the two isolation frequencies.

Thus, the present preferred embodiment is provided with the plurality of slits S1 and S3 having different lengths, thus achieving different resonant frequencies and achieving different isolation frequencies. In other words, since the slits S1 and S3 are electromagnetically coupled to the antenna element 1 and the ground conductor 2 at different frequencies, the antenna element 1 and the ground conductor 2 have a plurality of resonant frequencies, and also have a plurality of isolation frequencies. Thus, the antenna apparatus can operate at multiple frequencies by selectively shifting the operating frequency of the antenna element 1 and the ground conductor 2 to one of the isolation frequencies.

In the present preferred embodiment, instead of configuring the slits S1 and S3 having different lengths, the slits S1 and S3 may be configured with the same length, for achieving a single isolation frequency. In this case, it is possible to use matching circuits 11 and 12 and an MIMO communication circuit 10 having fixed operating frequencies as in the first preferred embodiment, instead of the matching circuits 11A and 12A and the MIMO communication circuit 10A, and thus eliminate the controller 13. In this case, furthermore, since the feed lines F3 and F4 are balanced feed lines, the antenna apparatus may be configured to have only the slit S3 on the ground conductor 2, without providing the slit S1 on the antenna element 1. According to this configuration, it is possible to increase flexibility in the configuration of the antenna apparatus.

As described above, the antenna apparatus of the present preferred embodiment can operate the single antenna element 1 as two antenna portions, while ensuring isolation between the feed ports at a plurality of isolation frequencies with a simple configuration, and transmit and/or receive multiple radio signals simultaneously.

Fourth Preferred Embodiment

Figure 4:
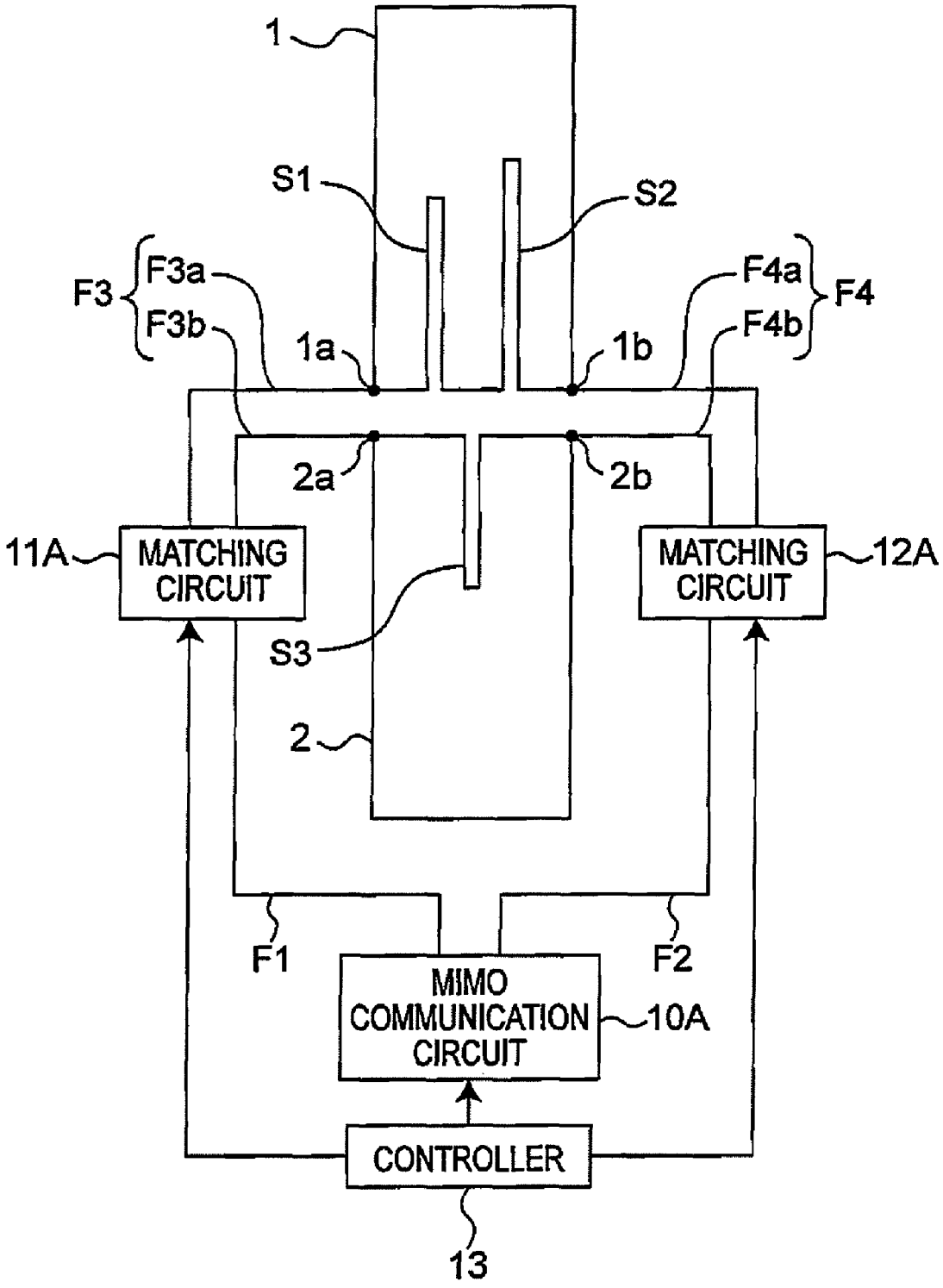
FIG. 4 is a block diagram showing a schematic configuration of an antenna apparatus according to a fourth preferred embodiment of the present invention.

FIG. 4 is a block diagram showing a schematic configuration of an antenna apparatus according to a fourth preferred embodiment of the present invention. As in the antenna apparatus of the present preferred embodiment, it is possible to combine the configurations of antenna apparatuses according to the second and third preferred embodiments.

Referring to FIG. 4, an antenna element 1 has slits S1 and S2 between feed points 1*a* and 1*b*, as in the case of the second preferred embodiment, and a ground conductor 2 has a slit S3 between connection points 2*a* and 2*b*, as in the case of the third preferred embodiment. The slits S1, S2, and S3 are preferably configured with, e.g., different lengths from one another, so as to achieve different resonant frequencies and ensure isolation between feed ports at different frequencies. In the present preferred embodiment, the three slits S1, S2, and S3 are provided between the feed ports, thus achieving three different isolation frequencies. Each of feed lines F3 and F4 is configured as a balanced feed line. A controller 13 adjusts the operating frequencies of matching circuits 11A and 12A, and thus, selectively shifts the operating frequency of the antenna element 1 and the ground conductor 2 to one of the three isolation frequencies.

Thus, the present preferred embodiment is provided with the plurality of slits S1, S2, and S3 with different lengths, thus achieving different resonant frequencies and achieving different isolation frequencies. In other words, since the slits S1, S2, and S3 are electromagnetically coupled to the antenna element 1 and the ground conductor 2 at different frequencies, the antenna element 1 and the ground conductor 2 have a plurality of resonant frequencies, and also have a plurality of isolation frequencies. Thus, the antenna apparatus can operate at multiple frequencies by selectively shifting the operating frequency of the antenna element 1 and the ground conductor 2 to one of the isolation frequencies.

The positions of slits are not limited to that descried in the first to fourth preferred embodiments, and it is possible to use a configuration in which at least one slit is provided on at least one of the antenna element 1 and the ground conductor 2.

As described above, the antenna apparatus of the present preferred embodiment can operate the single antenna element 1 as two antenna portions, while ensuring isolation between the feed ports at a plurality of isolation frequencies with a simple configuration, and transmit and/or receive multiple radio signals simultaneously.

Fifth Preferred Embodiment

Figure 5:
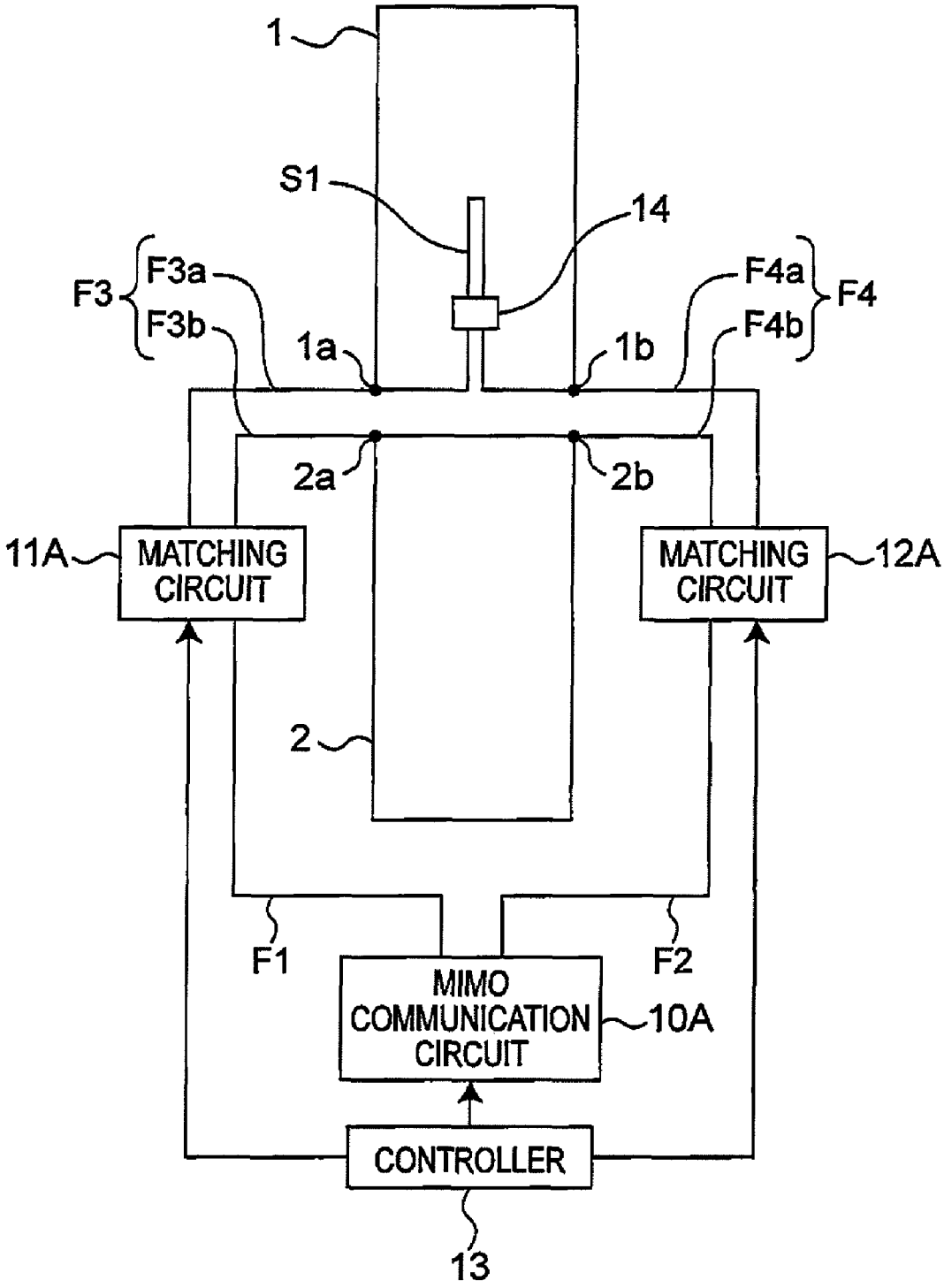
FIG. 5 is a block diagram showing a schematic configuration of an antenna apparatus according to a fifth preferred embodiment of the present invention.

FIG. 5 is a block diagram showing a schematic configuration of an antenna apparatus according to a fifth preferred embodiment of the present invention. The antenna apparatus of the present preferred embodiment is characterized by including a single slit S1 with a trap circuit 14 for ensuring isolation between feed ports at a plurality of isolation frequencies, instead of including a plurality of slits S1 and S2 in an antenna element 1 as in the second preferred embodiment.

Referring to FIG. 5, the antenna apparatus of the present preferred embodiment is provided with the trap circuit 14 at a position along the slit S1, with a certain distance from an opening of the slit S1. The trap circuit 14 is made of an inductor (L) and a capacitor (C) connected in parallel, and is open only at a resonant frequency of the parallel connected LC. Accordingly, the trap circuit 14 makes the entire slit S1 resonate at this resonant frequency, and makes only a section of the slit S1 from the opening to the trap circuit 14 resonate at other frequencies deviated from this resonant frequency. Thus, since the effective length of the slit S1 changes depending on the frequency, the antenna apparatus of the present preferred embodiment is configured to change the effective length of the slit S1 by changing the operating frequency of the antenna element 1, thus achieving different resonant frequencies and ensuring isolation between feed ports at different frequencies. The present preferred embodiment can achieve two different isolation frequencies, by changing the operating frequency of the antenna element 1 to change the effective length of the slit S1. A controller 13 adjusts the operating frequencies of matching circuits 11A and 12A and a MIMO communication circuit 10A, and thus, selectively shifts the operating frequency of the antenna element 1 to one of the two isolation frequencies. In the present preferred embodiment with the above-described configuration, the antenna apparatus can operate at multiple frequencies.

As described above, the antenna apparatus of the present preferred embodiment can operate the single antenna element 1 as two antenna portions, while ensuring isolation between the feed ports at a plurality of isolation frequencies with a simple configuration, and transmit and/or receive multiple radio signals simultaneously.

Sixth Preferred Embodiment

Figure 6:
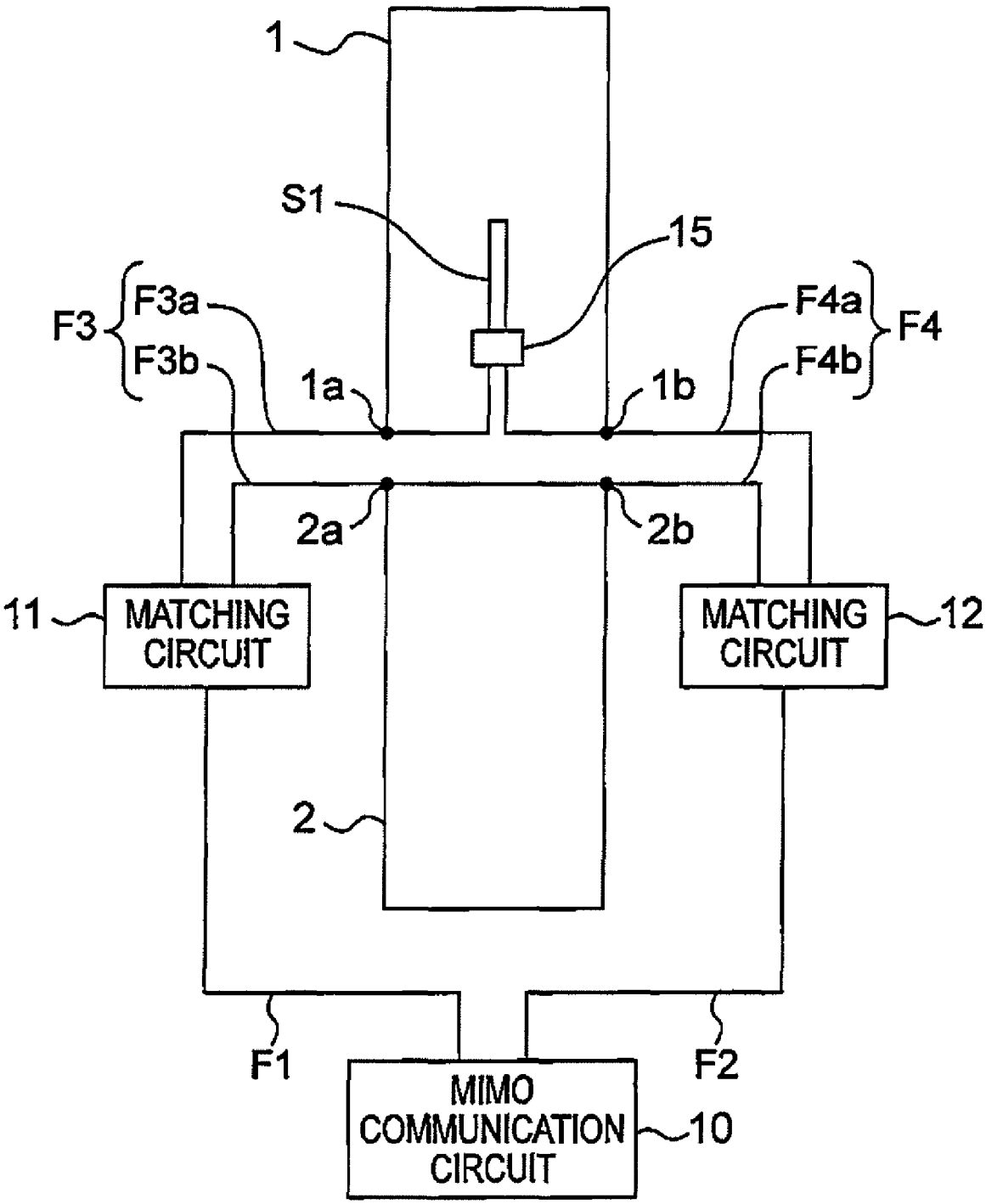
FIG. 6 is a block diagram showing a schematic configuration of an antenna apparatus according to a sixth preferred embodiment of the present invention.

FIG. 6 is a block diagram showing a schematic configuration of an antenna apparatus according to a sixth preferred embodiment of the present invention. The antenna apparatus of the present preferred embodiment is characterized by including a reactance element 15 at a certain position along the slit S1, in addition to changing the length of a slit S1 as in the first preferred embodiment, for adjusting the resonant frequency of an antenna element 1 and a frequency at which isolation can be ensured.

Referring to FIG. 6, the antenna apparatus of the present preferred embodiment has the configuration of FIG. 1, and further has the reactance element 15 at a position along the slit S1, with a certain distance from an opening of the slit S1. As will be described later with reference to FIGS. 10A, 10B, and 11, since the resonant frequency of the antenna element 1 and the frequency at which isolation can be ensured change depending on the length of the slit S1, the length of the slit S1 is determined to adjust these frequencies. In the present preferred embodiment, the reactance element 15 with a certain reactance value (i.e., a capacitor or inductor) is further provided at a certain position along the slit S1 for adjusting these frequencies. Since these frequencies also change depending on the position along the slit S1 where the reactance element 15 is provided, the position of the reactance element 15 is determined to adjust these frequencies. The amount of adjustment (amount of variation) of the frequencies is the maximum when the reactance element 15 is provided at the opening of the slit S1. Accordingly, it is possible finely adjust the resonant frequency of the antenna element 1 and the frequency at which isolation can be ensured by determining a reactance value of the reactance element 15 and then displacing a position where the reactance element 15 is mounted.

As described above, the antenna apparatus of the present preferred embodiment can operate the single antenna element 1 as two antenna portions, while ensuring isolation between feed ports with a simple configuration, and transmit and/or receive multiple radio signals simultaneously.

Seventh Preferred Embodiment

Figure 7:
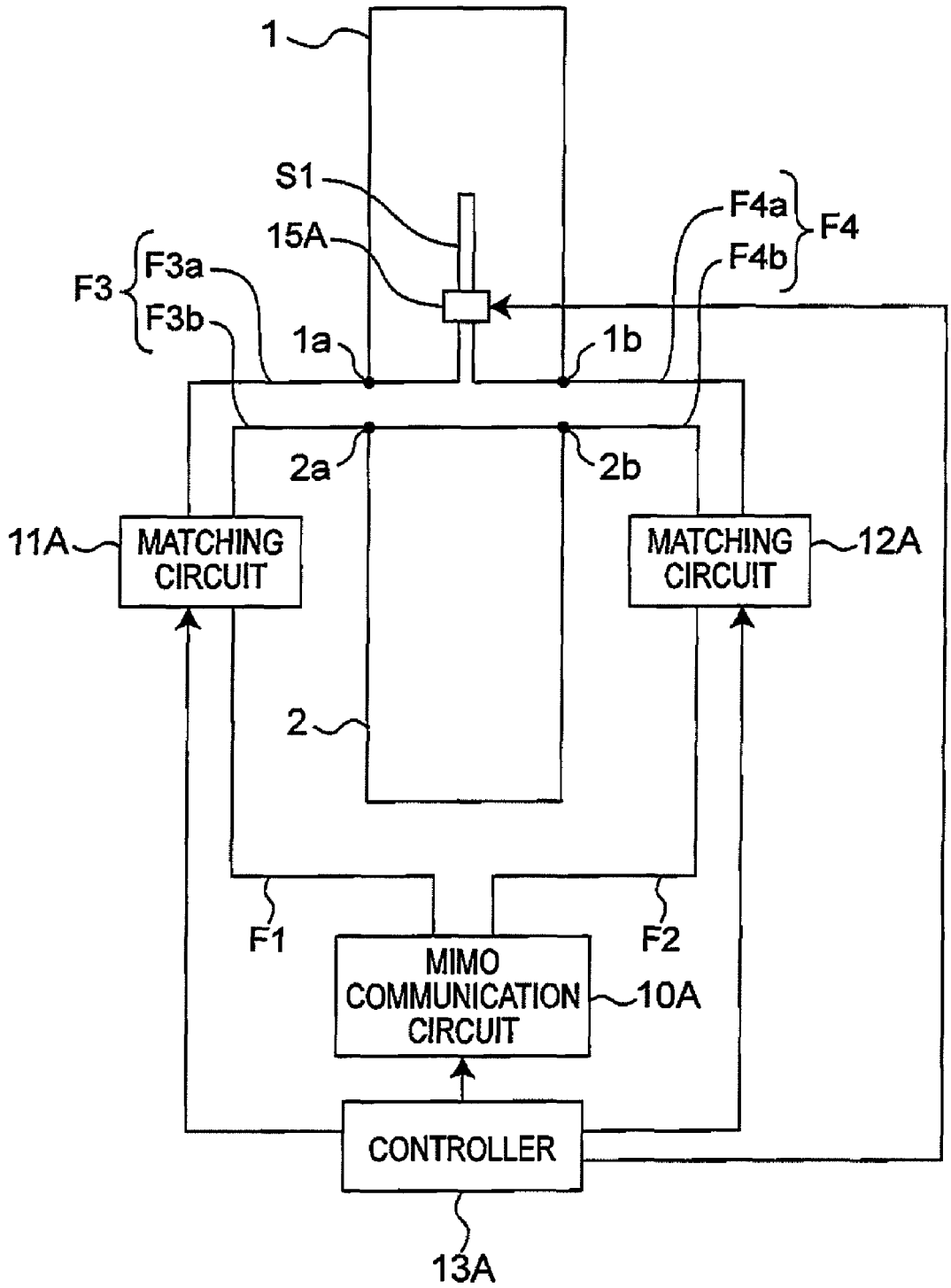
FIG. 7 is a block diagram showing a schematic configuration of an antenna apparatus according to a seventh preferred embodiment of the present invention.

FIG. 7 is a block diagram showing a schematic configuration of an antenna apparatus according to a seventh preferred embodiment of the present invention. The antenna apparatus of the present preferred embodiment is characterized by including a variable reactance element 15A whose reactance value changes under the control of a controller 13A, instead of a reactance element 15 of the sixth preferred embodiment. According to this configuration, the antenna apparatus of the present preferred embodiment can ensure isolation between feed ports at a plurality of isolation frequencies by having a single slit S1 with the variable reactance element 15A, without a plurality of slits S1 and S2 in an antenna element 1 as in the second preferred embodiment.

Referring to FIG. 7, the antenna apparatus of the present preferred embodiment is provided with the variable reactance element 15A at a position along the slit S1, with a certain distance from an opening of the slit S1. As the variable reactance element 15A, a capacitive reactance element can be used, e.g., including a variable capacitance element such as a varactor diode. The reactance value of the variable reactance element 15A is changed according to a control voltage applied by the controller 13A. The antenna apparatus of the present preferred embodiment is configured so as to change the reactance value of the variable reactance element 15A, thus achieving different resonant frequencies of the antenna element 1, and ensuring isolation between the feed ports at different frequencies. The controller 13A changes the reactance value of the variable reactance element 15A, and additionally, adjusts the operating frequencies of matching circuits 11A and 12A and a MIMO communication circuit 10A, and thus shifts the operating frequency of the antenna element 1 to an isolation frequency which is determined by a reactance value of the variable reactance element 15A. In the present preferred embodiment with the above-described configuration, the antenna apparatus can operate at multiple frequencies.

The present preferred embodiment can change the operating frequency of the antenna element 1 according to an application to be used, by adaptively changing the reactance value of the variable reactance element 15A.

As described above, the antenna apparatus of the present preferred embodiment can operate the single antenna element 1 as two antenna portions, while ensuring isolation between the feed ports at a plurality of isolation frequencies with a simple configuration, and transmit and/or receive multiple radio signals simultaneously.

Eighth Preferred Embodiment

Figure 8:
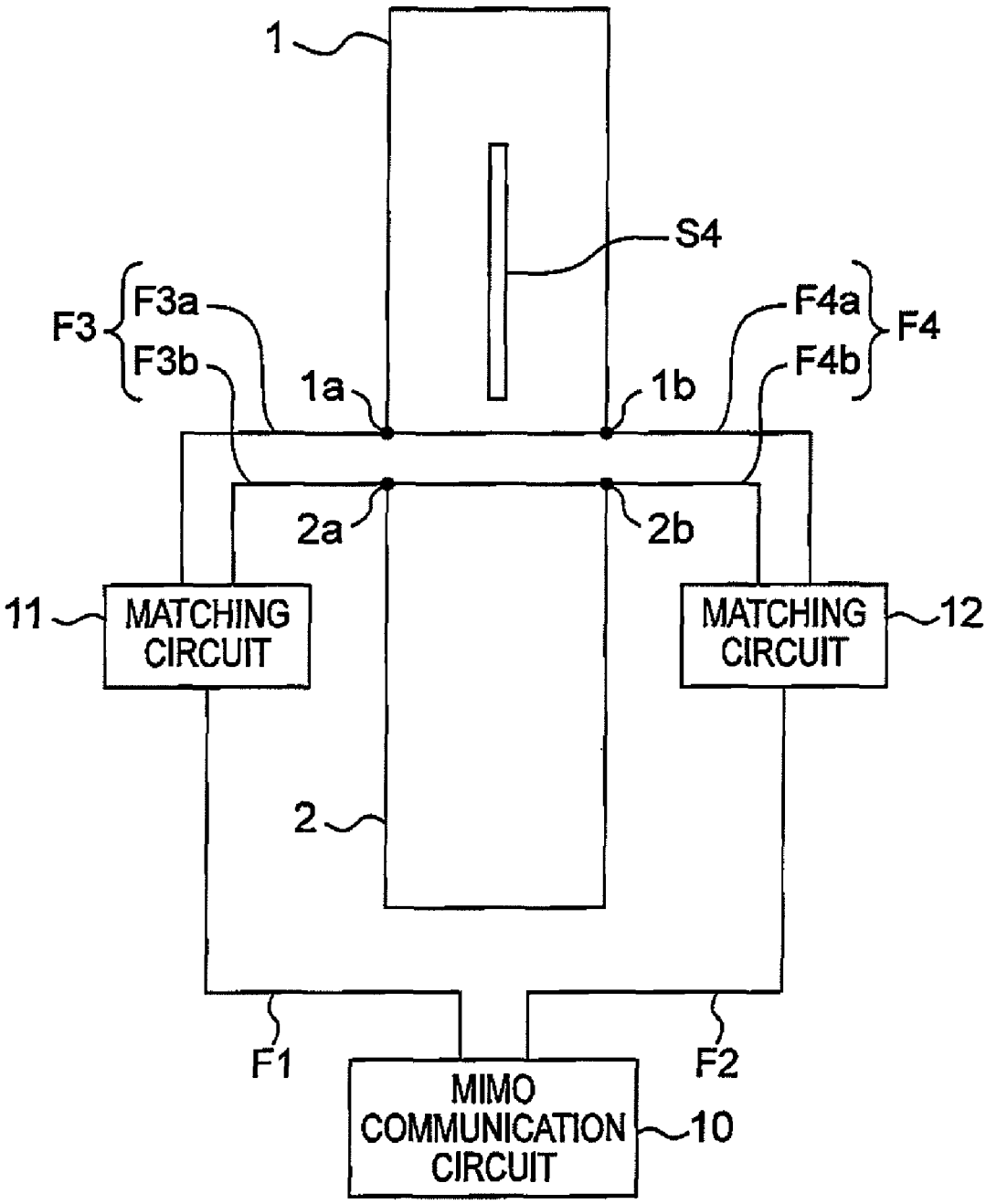
FIG. 8 is a block diagram showing a schematic configuration of an antenna apparatus according to an eighth preferred embodiment of the present invention.

FIG. 8 is a block diagram showing a schematic configuration of an antenna apparatus according to an eighth preferred embodiment of the present invention. The antenna apparatus of the present preferred embodiment is characterized by including a slot S4 with no opening on a side of an antenna element 1, instead of a slit S1 of the first preferred embodiment. Even when using such a configuration, it is possible to operate the single antenna element 1 as two antenna portions, while ensuring isolation between feed ports with a simple configuration, and transmit and/or receive multiple radio signals simultaneously. The number of slots is not limited to one, and two or more slots may be provided on at least one of the antenna element 1 and a ground conductor 2. When each of feed lines F3 and F4 is a balanced feed line, a slot may be provided only on the ground conductor 2 without providing the slot S4 on the antenna element 1, as in the case of the third preferred embodiment. According to the configuration of the present preferred embodiment, it is possible to increase flexibility in the configuration of the antenna apparatus.

Ninth Preferred Embodiment

Figure 9:
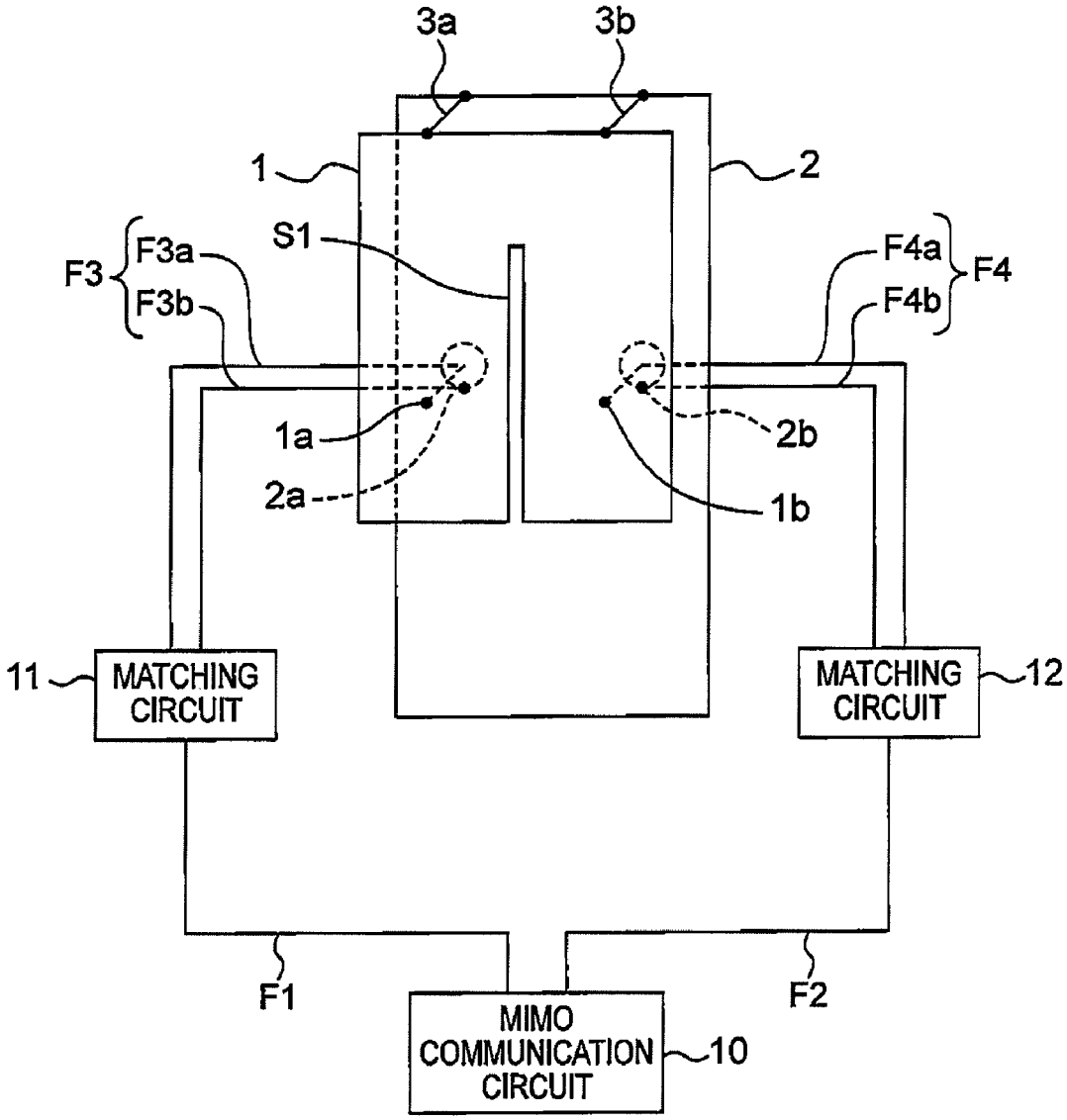
FIG. 9 is a perspective view showing a schematic configuration of an antenna apparatus according to a ninth preferred embodiment of the present invention.

FIG. 9 is a perspective view showing a schematic configuration of an antenna apparatus according to a ninth preferred embodiment of the present invention. The antenna apparatus of the present preferred embodiment is characterized by a configuration of a planar inverted-F antenna apparatus, instead of the configurations of dipole antennas as in the first to eighth preferred embodiments.

Referring to FIG. 9, the antenna apparatus includes an antenna element 1 and a ground conductor 2, each made of a rectangular conductive plate. The antenna element 1 and the ground conductor 2 are provided in parallel so as to overlap each other, with a certain distance therebetween. One side of the antenna element 1 and one side of the ground conductor 2 are arranged close to each other, and are mechanically and electrically connected to each other by linear connecting conductors 3*a* and 3*b*. The antenna element 1 is provided with a slit S1 having a certain width and a certain length, and extending between the side to which the connecting conductors 3*a* and 3*b* are connected, and its opposite side. One end of the slit S1 is configured as an open end, with an opening at about the center of the opposite side of the side to which the connecting conductors 3*a* and 3*b* are connected. On the antenna element 1, feed points 1*a* and 1*b* are provided such that the slit S1 is located between them. The feed points 1*a* and 1*b* are respectively connected with feed lines F3 and F4 which penetrate through the ground conductor 2 from its back side. The feed lines F3 and F4 are, e.g., coaxial cables. Signal lines F3*a* and F4*a* as inner conductors of the coaxial cables are respectively connected to the feed points 1*a* and 1*b*, and signal lines F3*b* and F4*b* as outer conductors of the coaxial cables are respectively connected to the ground conductor 2 at connection points 2*a* and 2*b*. Furthermore, the feed lines F3 and F4 are connected to a MIMO communication circuit 10 through matching circuits 11 and 12 and feed lines F1 and F2, respectively, as in the case of the first preferred embodiment. The present preferred embodiment is configured as described above, and accordingly, the antenna element 1 is excited as a first antenna portion through one feed point 1*a*, and simultaneously, the antenna element 1 is excited as a second antenna portion through the other feed point 1*b*, thus operating the single antenna element 1 as two antenna portions. In a modified preferred embodiment, the antenna element 1 and the ground conductor 2 may be connected by a single conductive plate, instead of connecting by the plurality of connecting conductors 3*a* and 3*b*.

As described above, the antenna apparatus of the present preferred embodiment can operate the single antenna element 1 as two antenna portions, while ensuring isolation between feed ports with a simple configuration, and transmit and/or receive multiple radio signals simultaneously.

The following Example 1 to Example 7 demonstrate simulation results obtained when using antenna apparatuses of the preferred embodiments modeled as copper plate slit antenna apparatuses.

EXAMPLE 1

Figure 10A:
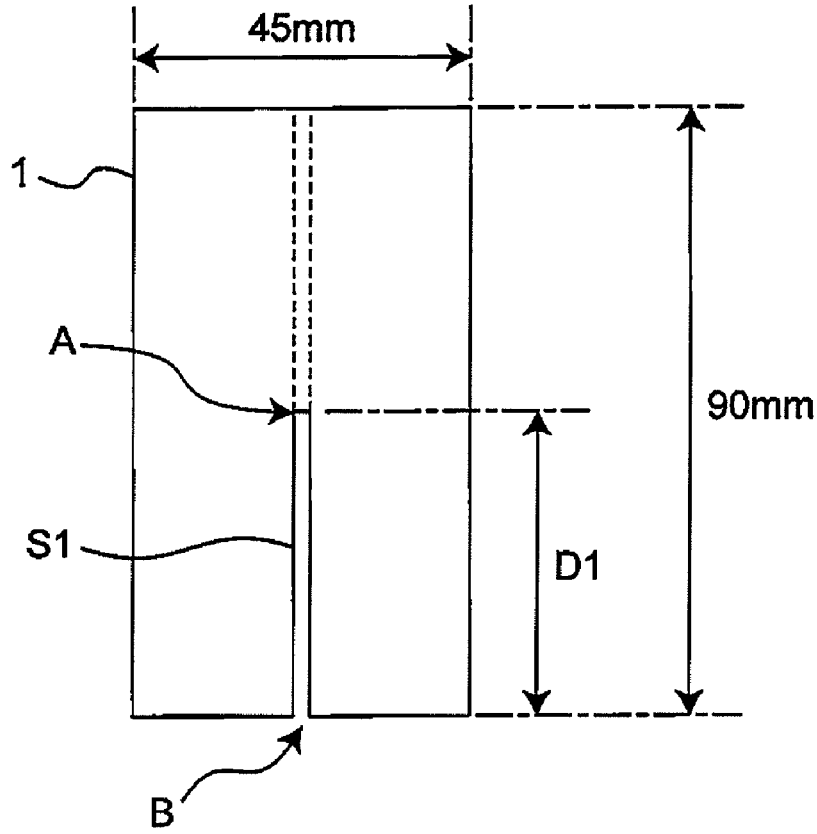
FIG. 10A is a diagram showing a configuration of an antenna element 1 of an antenna apparatus according to Example 1 of the present invention.
Figure 10B:
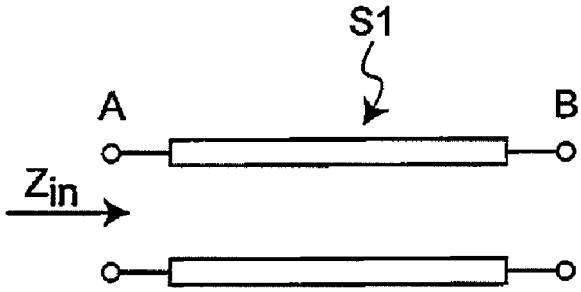
FIG. 10B is a diagram showing an equivalent circuit of a slit S1 of FIG. 10A.

FIG. 10A is a diagram showing a configuration of an antenna element 1 of an antenna apparatus according to Example 1 of the present invention. FIG. 10B is a diagram showing an equivalent circuit of a slit S1 of FIG. 10A. The antenna apparatus of the present example corresponds to an antenna apparatus of the first preferred embodiment. A simulation of the present example uses a variable length D1 of the slit S1, and shows a resonant frequency characteristic versus the length D1. Assuming that the width of the slit S1 is 1 mm, and this assumption applies to simulations of Example 2 to Example 7.

When adjusting the resonant frequency, the slit S1 is considered as a transmission line, which is a resonator of the slit S1. The slit S1 of FIG. 10A has the length D1, a characteristic impedance $Z_0$, and a propagation constant β. A radio signal with a wavelength λ is fed. FIG. 10B shows the slit S1 with two ends A and B, the upper end A is a short-circuited end, and the lower end B is an open end. Since the end B is open, an input impedance $Z_{in}$ as seen from the end A is given by the following equation.

$$Z_{in} = -jZ_0 \frac{1}{\tan(\beta \cdot D1)} \tag{1}$$

In this case, since the end A is a short-circuited end, the resonance condition of the equivalent circuit of FIG. 103 is that the input impedance $Z_{in}$ as seen from the end A is 0. That is, resonance occurs when tan(β·D1) in the equation (1) is infinite, and accordingly, the input impedance $Z_{in}$ is 0 when β·D1=n/2, i.e., when D1=λ/4 since β=2π/λ. When the speed of light is denoted by c [m/s] and the slit length D1 is given in meter, the relationship between a resonant frequency "f" [Hz] and the length D1 of the slit S1 is given by the following equation.

$$f = \frac{c}{4 \cdot D1} = \frac{3 \times 10^8}{4 \cdot D1} = \frac{0.075}{D1} \times 10^9 \quad (2)$$

Figure 11:
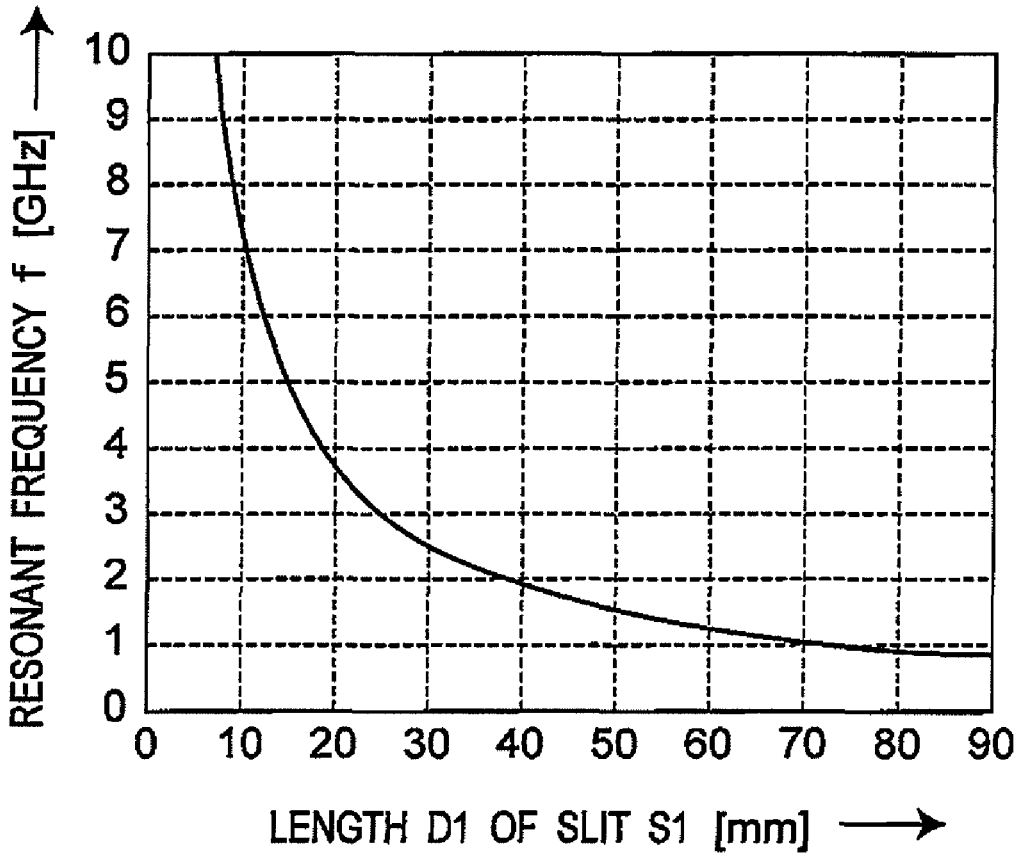
FIG. 11 is a graph showing a resonant frequency characteristic versus a length D1 of the slit S1 in the antenna apparatus of FIG. 10A.

FIG. 11 is a graph showing the resonant frequency characteristic "f" versus the length D1 of the slit S1 in the antenna apparatus of FIG. 10A. Under conditions that the end B is open, the resonant frequency "f" decreases to 0.84 GHz when extending the length D1 of the slit S1 to 90 mm, i.e., when completely separating the antenna element 1 into an antenna portion on the left side of the slit S1 and another antenna portion on the right side of the slit S1.

As described previously, since the slit S1 is electromagnetically coupled to the antenna element 1 itself, the resonant frequency of the antenna element 1 changes according to the frequency of the resonance conditions of the slit S1, as compared with the case without the slit S1. However, when the frequency of the resonance conditions of the slit S1 is largely deviated from the resonant frequency of the antenna element 1 itself, the degree of coupling is low, and thus, the change in the resonant frequency of the antenna element 1 is small. According to FIG. 11, the longer the slit S1, the lower the frequency of the resonance conditions of the slit S1, and the shorter the slit S1, the higher the frequency of the resonance conditions. Therefore, the resonant frequency of the antenna element 1 can be adjusted by the length D1 of the slit S1.

EXAMPLE 2

Figure 12:
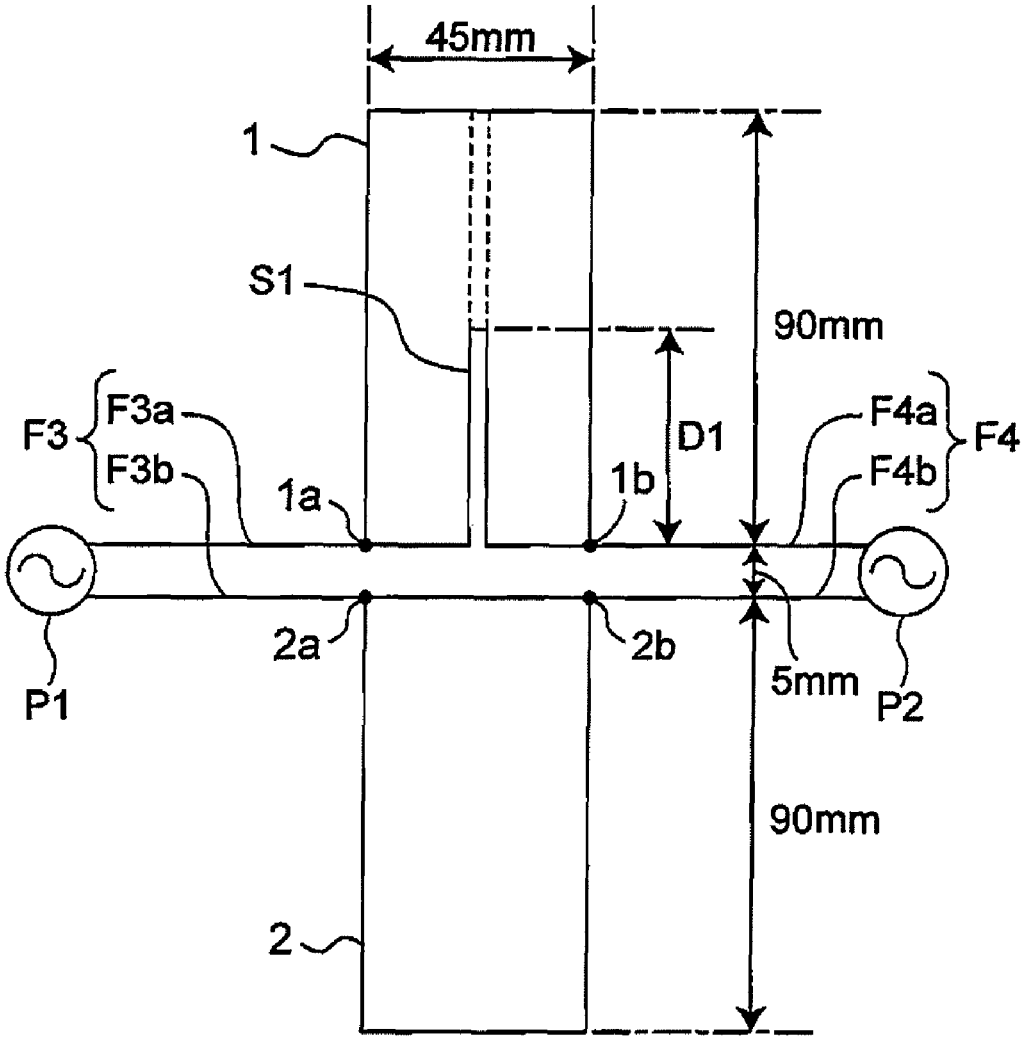
FIG. 12 is a diagram showing a schematic configuration of an antenna apparatus according to Example 2 of the present invention.

FIG. 12 is a diagram showing a schematic configuration of an antenna apparatus according to Example 2 of the present invention. The antenna apparatus of the present example also corresponds to an antenna apparatus of the first preferred embodiment, as in the case of the antenna apparatus of Example 1. A simulation of the present example shows that the resonant frequency of an antenna element 1 and the isolation frequency change depending on a length D1 of a slit S1.

Referring to FIG. 12, each of the antenna element 1 and a ground conductor 2 is made of a single-sided copper-clad substrate with size of 45×90 mm. A conductor is entirely removed at the center in width of the antenna element 1 by a width of 1 mm, and a copper tape is attached to a portion where the conductor is removed, thus forming a slit S1 with a desired length D1. The length D1 of the slit S1 is adjusted to examine a change in the frequency characteristics of the antenna apparatus. Further, as feed lines F3 and F4, semi-rigid cables with a length of 50 mm are respectively connected to two feed ports of the antenna apparatus (i.e., a feed port including a feed point 1*a* and a connection point 2*a*, and another feed port including a feed point 1*b* and a connection point 2*b*). Inner conductors of the respective semi-rigid cables are soldered to the substrate of the antenna element 1 over a length of 5 mm, and outer conductors of the respective semi-rigid cables are soldered to the substrate of the ground conductor 2 over a length of 40 mm. Furthermore, the feed lines F3 and F4 are respectively connected to signal sources, which are schematically shown as "P1" and "P2" in FIG. 12.

Figure 13:
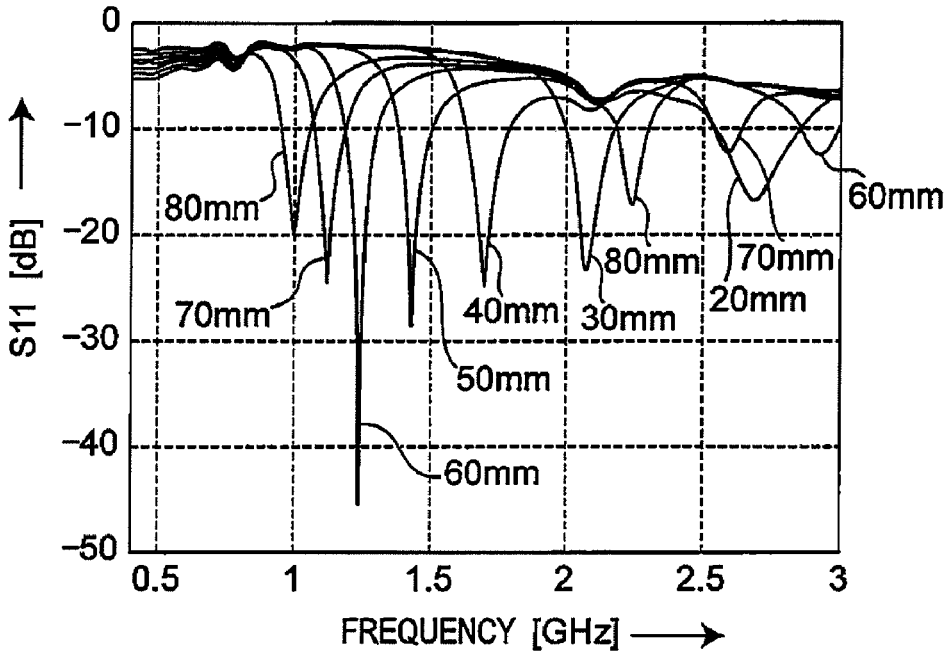
FIG. 13 is a graph showing a reflection coefficient parameter S11 versus frequency for different lengths D1 of a slit S1 in the antenna apparatus of FIG. 12.
Figure 14:
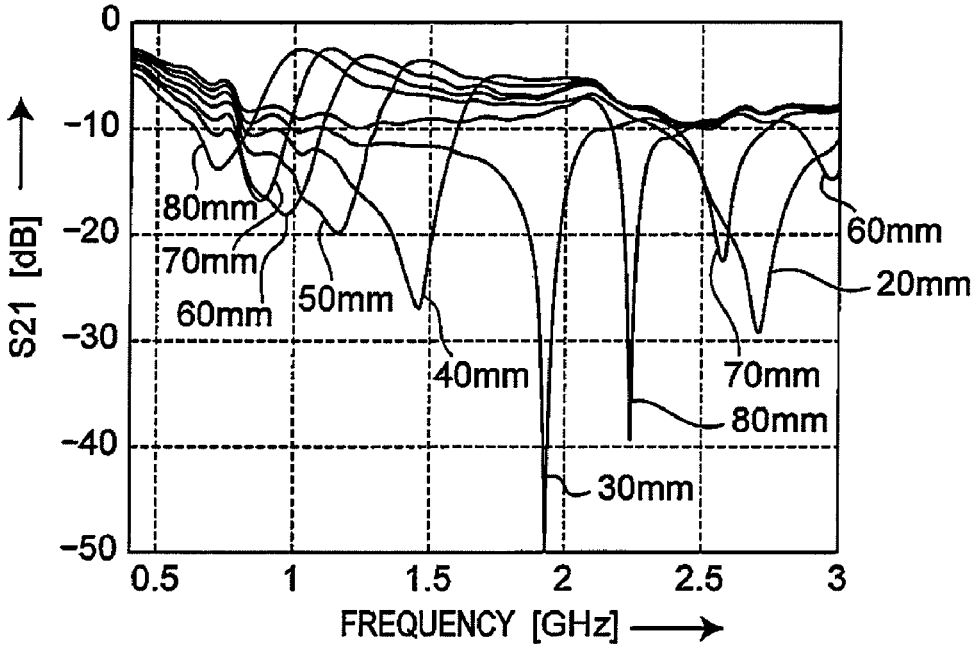
FIG. 14 is a graph showing a transmission coefficient parameter S21 versus frequency for different lengths D1 of the slit S1 in the antenna apparatus of FIG. 12.

Next, referring to FIGS. 13 and 14, it is shown how the frequency characteristics of S-parameters S11 and S21 for the two feed ports change when changing the length D1 of the slit S1. FIG. 13 is a graph showing the a reflection coefficient parameter S11 versus frequency for different lengths D1 of the slit S1 in the antenna apparatus of FIG. 12. FIG. 14 is a graph showing a transmission coefficient parameter S21 (i.e., isolation characteristic between the feed ports) versus frequency for different lengths D1 of the slit S1 in the antenna apparatus of FIG. 12. Since the antenna apparatus of FIG. 12 has a symmetric structure, parameter S12 is the same as S21, and parameter S22 is the same as S11. According to FIGS. 13 and 14, it can be seen that the resonant frequency of the antenna element 1 and the isolation frequency change by changing the length D1 of the slit S1.

The following table shows the relationship between a change in the resonant frequency of the antenna element 1 (in GHz) and a change in isolation frequency (in GHz) when changing the length D1 of the slit S1 (in mm).

TABLE 1

| D1 | S11 | S21 |
|---|---|---|
| 20 | 2.680 | 2.703 |
| 25 | 2.313 | 2.309 |
| 30 | 2.074 | 1.934 |
| 35 | 1.856 | 1.658 |
| 40 | 1.700 | 1.463 |
| 45 | 1.538 | 1.278 |
| 50 | 1.430 | 1.172 |
| 55 | 1.333 | 1.068 |
| 60 | 1.239 | 0.974 |
| 65 | 1.170 | 0.902 |
| 70 | 1.120 | 0.876 |
| 75 | 1.063 | 0.855 |
| 80 | 0.996 | 0.732 |
| 85 | 0.954 | 0.731 |

Figure 15:
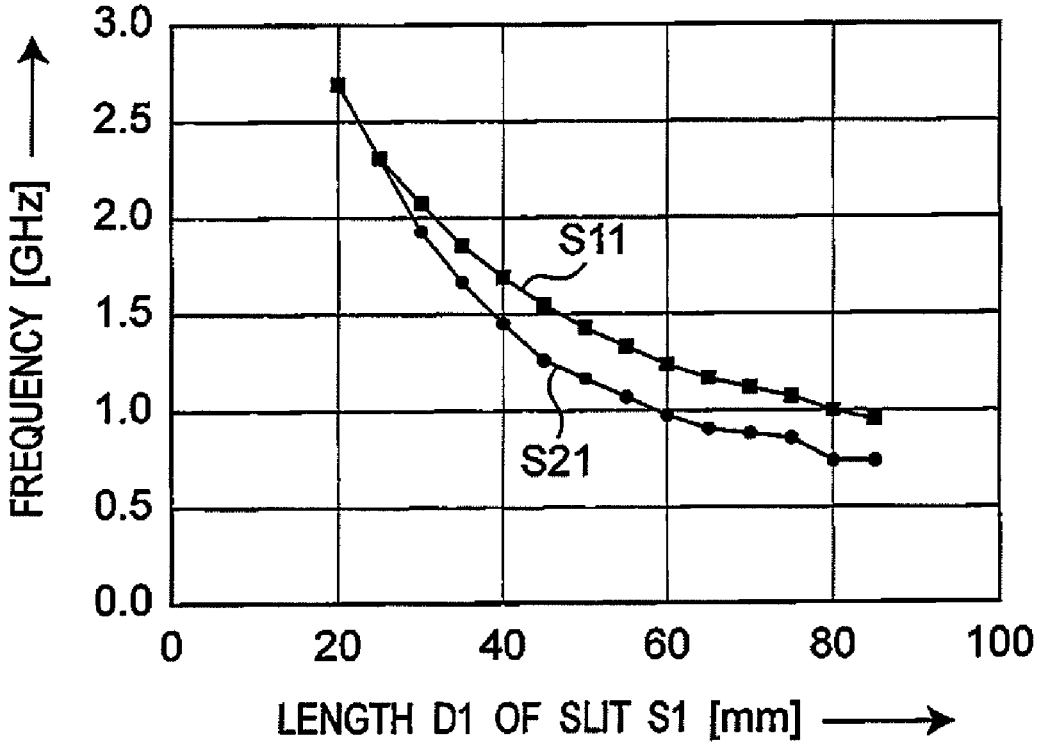
FIG. 15 is a graph showing frequency characteristics versus the length D1 of the slit S1 in the antenna apparatus of FIG. 12.

The relationship shown in the above Table 1 is also shown in a graph of FIG. 15. FIG. 15 is a graph showing frequency characteristics versus the length D1 of the slit S1 in the antenna apparatus of FIG. 12. According to Table 1 and FIG. 15, it can be seen that the longer the slit S1, the lower the resonant frequency of the antenna element 1 and the isolation frequency. As to the parameter S21, it is considered that the isolation frequency has decreased because of an increase in a diverting path length from the feed point 1*a* to the feed point 1*b*. The ranges of frequency variation are 960 MHz to 2.6 GHz for the parameter S11, and 730 MHz to 2.7 GHz for the parameter S21.

EXAMPLE 3

Figure 16:
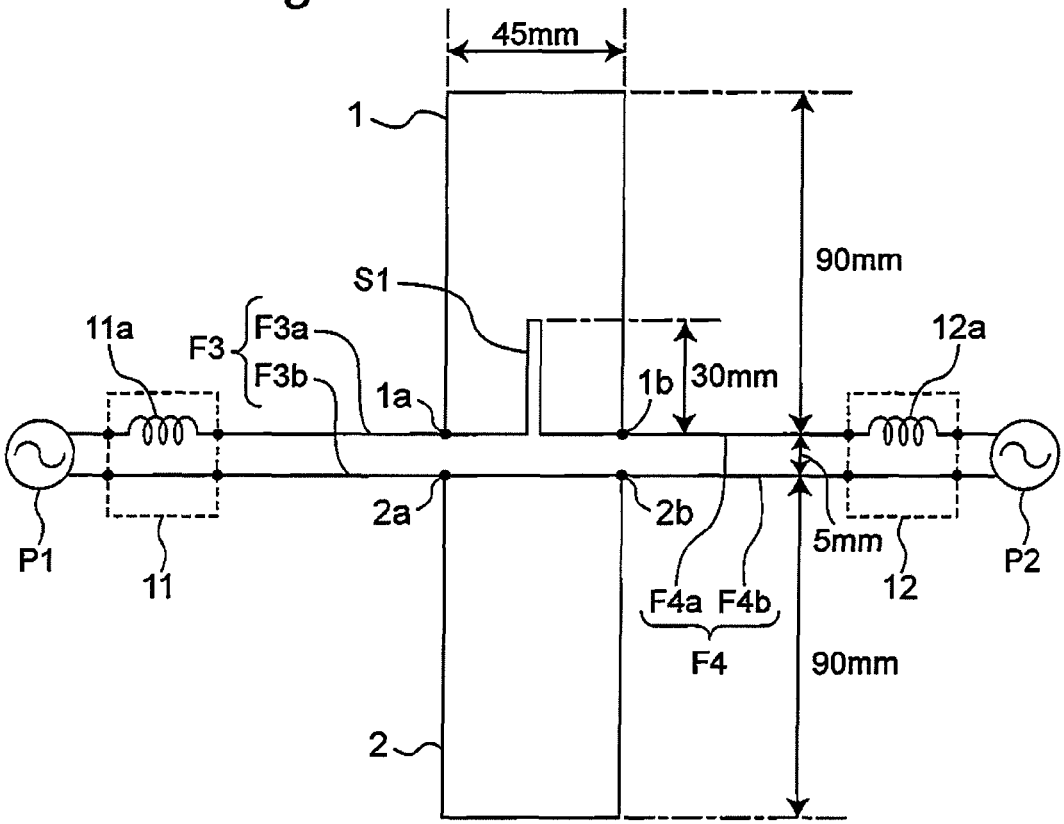
FIG. 16 is a diagram showing a schematic configuration of an antenna apparatus according to Example 3 of the present invention.

FIG. 16 is a diagram showing a schematic configuration of an antenna apparatus according to Example 3 of the present invention. The antenna apparatus of the present example also corresponds to an antenna apparatus of the first preferred embodiment, as in the case of the antenna apparatus of Example 1. A simulation of the present example shows effects by providing the antenna apparatus with matching circuits 11 and 12 for the purpose of resonating an antenna element 1 at a certain frequency and ensuring high isolation between feed ports.

Referring to FIG. 16, the antenna element 1 and a ground conductor 2 have the same configuration as that of Example 2 (see FIG. 12), and the length of a slit S1 is fixed at 30 mm. Furthermore, the matching circuits 11 and 12 are inserted into feed lines F3 and F4. Specifically, the matching circuits 11 and 12 are configured by inserting a 3.3 nH inductor 11*a* into a signal line F3*a* of the feed line F3 in series, and inserting a 3.3 nH inductor 12*a* into a signal line F4*a* of the feed line F4 in series.

Figure 17:
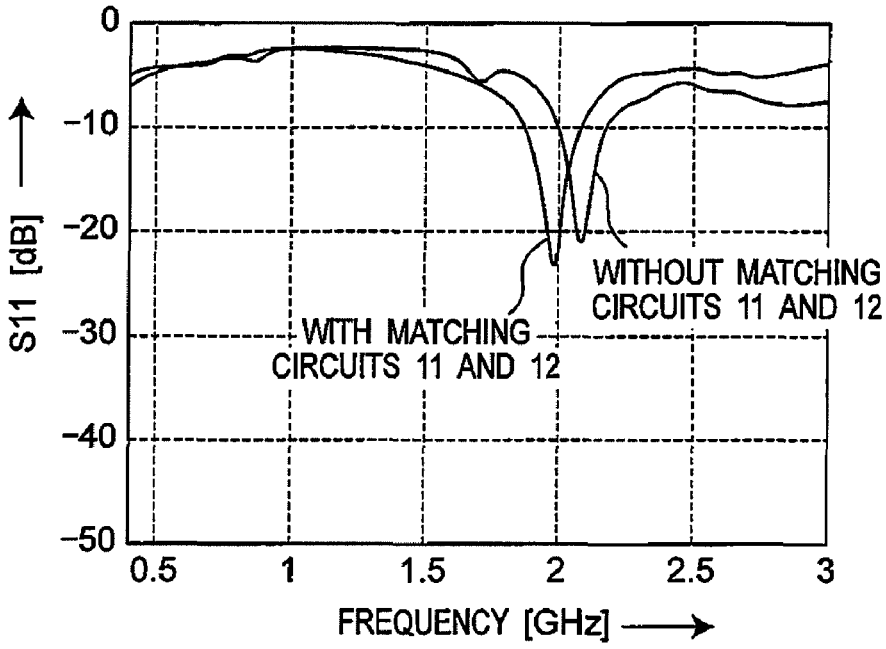
FIG. 17 is a graph showing a reflection coefficient parameter S11 versus frequency with and without matching circuits 11 and 12 in the antenna apparatus of FIG. 16.
Figure 18:
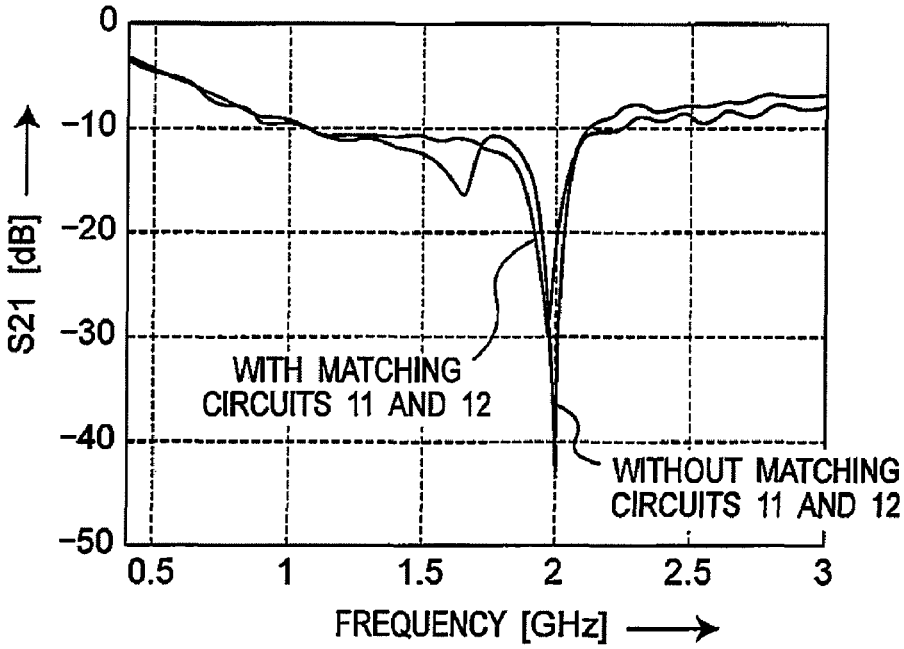
FIG. 18 is a graph showing a transmission coefficient parameter S21 versus frequency with and without the matching circuits 11 and 12 in the antenna apparatus of FIG. 16.
Figure 19A:
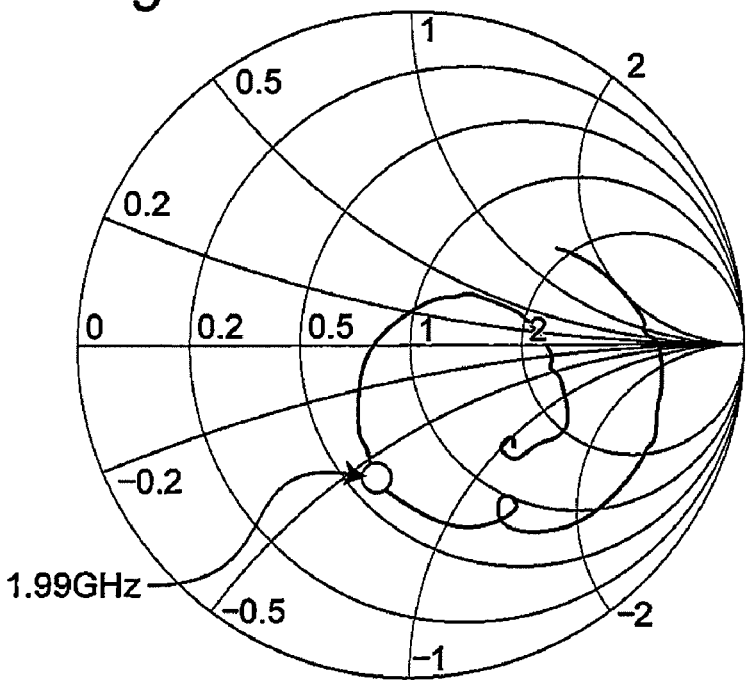
FIG. 19A is a Smith chart showing an impedance characteristic of the antenna apparatus of FIG. 16 without the matching circuits 11 and 12.
Figure 19B:
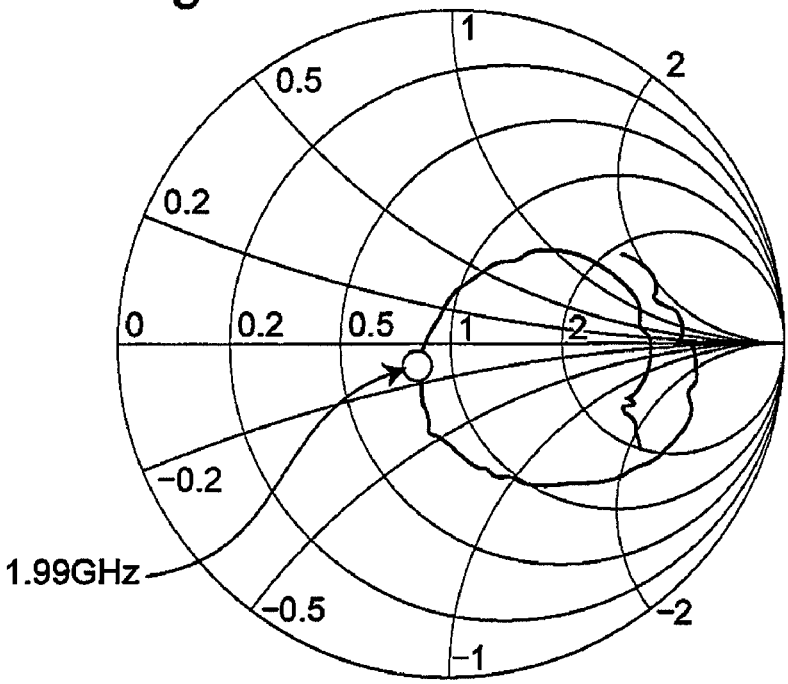
FIG. 19B is a Smith chart showing an impedance characteristic of the antenna apparatus of FIG. 16 with the matching circuits 11 and 12.

FIG. 17 is a graph showing a reflection coefficient parameter S11 versus frequency with and without the matching circuits 11 and 12 in the antenna apparatus of FIG. 16. FIG. 18 is a graph showing a transmission coefficient parameter S21 versus frequency with and without the matching circuits 11 and 12 in the antenna apparatus of FIG. 16. FIG. 19A is a Smith chart showing an impedance characteristic of the antenna apparatus of FIG. 16 without the matching circuits 11 and 12. FIG. 19B is a Smith chart showing an impedance characteristic of the antenna apparatus of FIG. 16 with the matching circuits 11 and 12. In this case, FIGS. 19A and 19B show impedance characteristics at a feed port on the side of a feed point 1*a*. It can be seen that according to FIG. 17, the resonant frequency of the antenna element 1 without the matching circuits 11 and 12 is 2.08 GHz, and according to FIG. 18, the isolation frequency without the matching circuits 11 and 12 is 1.99 GHz. The constant of the matching circuits 11 and 12 (i.e., an inductance of 3.3 nH) is set so as to shift the resonant frequency of the antenna element 1 with the matching circuits 11 and 12 to the isolation frequency of 1.99 GHz without the matching circuits 11 and 12, for matching these frequencies with each other. According to FIGS. 17 and 18, it can be seen that although the resonant frequency of the antenna element 1 changes by providing the matching circuits 11 and 12, the isolation frequency change little whether or not the matching circuits 11 and 12 are provided. As can be seen from FIG. 17, while the resonant frequency deviates by 90 MHz when no matching circuits 11 and 12 are provided, such a deviation decreases under 10 MHz by providing the matching circuits 11 and 12. When the matching circuits 11 and 12 are provided, it is a range from 1.96 to 2.00 GHz that both the parameters S11 and S21 are −20 dB or less, and thus, a 40 MHz band can be ensured. When the matching circuits 11 and 12 are provided, it is a range from 1.87 to 2.09 GHz that both the parameters S11 and S21 are −10 dB or less, and thus, a 220 MHz band can be ensured.

According to the simulation of the present example, it can be seen that providing the antenna apparatus with the matching circuits 11 and 12 results in resonating the antenna element 1 at a certain frequency and ensuring high isolation between the feed ports.

EXAMPLE 4

Figure 20A:
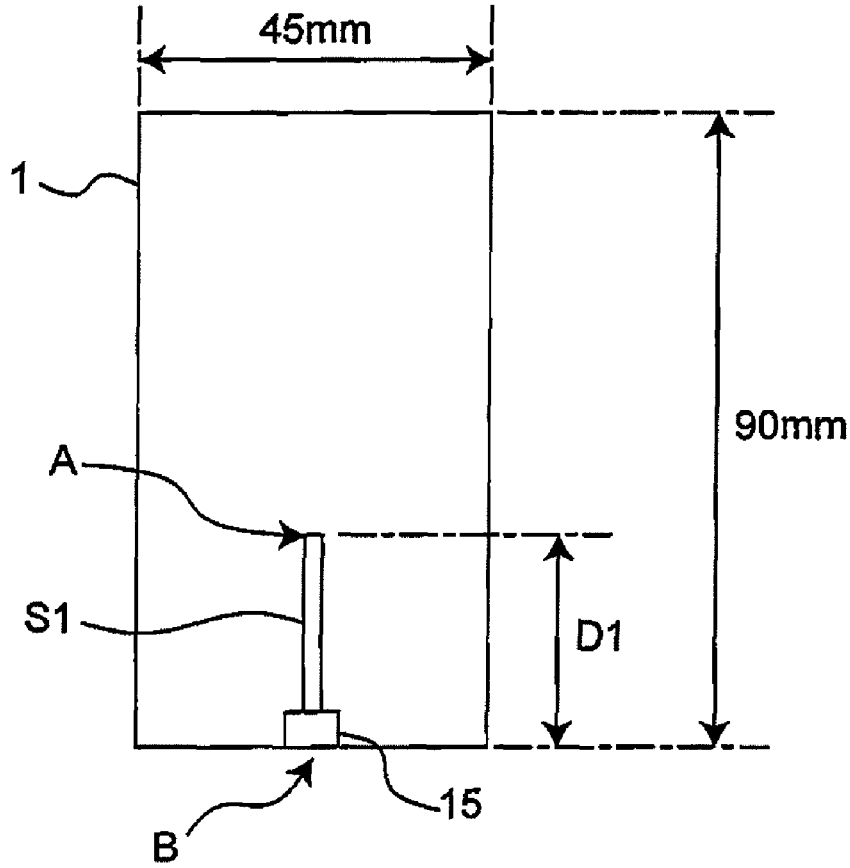
FIG. 20A is a diagram showing a configuration of an antenna element 1 of an antenna apparatus according to Example 4 of the present invention.
Figure 20B:
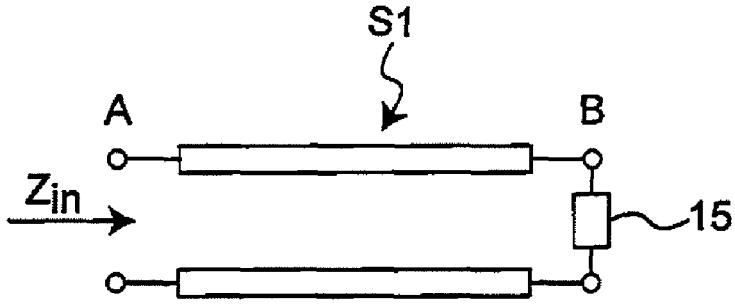
FIG. 20B is a diagram showing an equivalent circuit of a slit S1 and a reactance element 15 of FIG. 20A.
Figure 21:
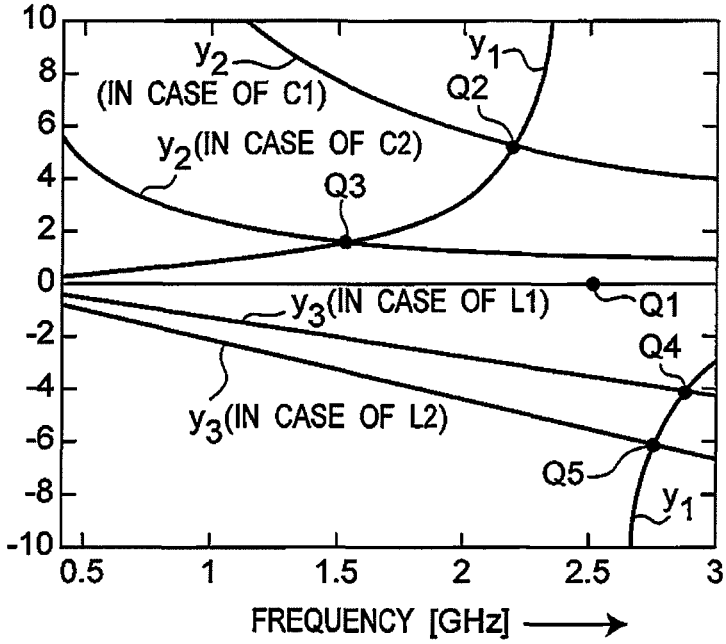
FIG. 21 is a graph showing the relationship between the reactance element 15 and frequency characteristics in the antenna element of FIG. 20A.
Figure 22:
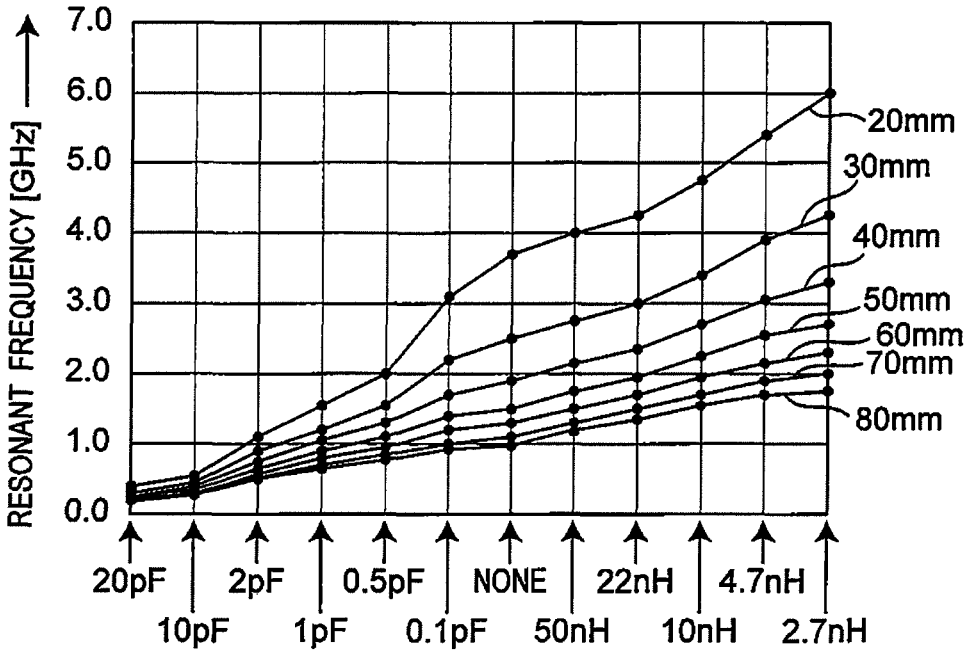
FIG. 22 is a graph showing resonant frequency characteristics versus the reactance value of the reactance element 15 for different lengths D1 of the slit S1 in the antenna element of FIG. 20A.

FIG. 20A is a diagram showing a configuration of an antenna element 1 of an antenna apparatus according to Example 4 of the present invention. FIG. 20B is a diagram showing an equivalent circuit of a slit S1 and a reactance element 15 of FIG. 20A. FIG. 21 is a graph showing the relationship between the reactance element 15 and frequency characteristics in the antenna element of FIG. 20A. FIG. 22 is a graph showing resonant frequency characteristics versus the reactance value of the reactance element 15 for different lengths D1 of the slit S1 in the antenna element of FIG. 20A. The antenna apparatus of the present example corresponds to an antenna apparatus of the sixth preferred embodiment. A simulation of the present example uses a variable length D1 of the slit S1 and a variable reactance value of the reactance element 15, and shows resonant frequency characteristics versus these variable parameters.

Referring to FIG. 20A, the antenna apparatus has the same configuration as an antenna apparatus of Example 1 (see FIG. 10A), and is further provided with a reactance element having a certain reactance value at an opening of the slit S1. The slit S1 has the length D1, a characteristic impedance $Z_0$, and a propagation constant 13. The reactance element 15 has a load impedance $Z_L$. A radio signal with a wavelength λ is fed. At first, the relationship between the reactance value and the resonant frequency when the length D1 of the slit S1 is fixed at 30 mm will be considered. FIG. 20A shows the slit S1 with two ends A and B, the upper end A is a short-circuited end, and the lower end B is an open end. Since the end B is open, an input impedance $Z_{in}$ as seen from the end A is given by the following equation.

$$Z_{in} = Z_0 \frac{Z_L + jZ_0 \tan(\beta \cdot D1)}{Z_0 + jZ_L \tan(\beta \cdot D1)} \tag{3}$$

In this case, since the end A is a short-circuited end, the resonance condition of the equivalent circuit of FIG. 20B is that the input impedance $Z_{in}$ as seen from the end A is 0, i.e., the numerator of a fractional expression on the right-hand side of the equation (3) is 0.

$$Z_L + jZ_0 \tan(\beta \cdot D1) = 0 \tag{4}$$

Thus, the resonance condition is modified from the equation (4) to the following equation.

$$\tan(\beta \cdot D1) = -Z_L / jZ_0 \tag{5}$$

In the graph of FIG. 21, the left-hand side of the equation (5) is plotted as a function $y_1$.

$$y_1 = \tan(\beta \cdot D1) \tag{6}$$

In the case of using a capacitor with a capacitance C as the reactance element 15 of FIG. 20A, the load impedance $Z_L = 1/j\omega C$. The tight-hand side of the equation (5) is given by the following function $y_2$.

$$y_2 = \frac{1}{\omega C Z_0} = \frac{1}{2\pi f C Z_0} \tag{7}$$

In FIG. 21, $y_2$ curves are plotted in the case of using a capacitor with a capacitance value C1, and in the case of using a capacitor with a capacitance value C2 higher than C1.

Further, in the case of using an inductor with an inductance L as the reactance element 15 of FIG. 20A, the load impedance $Z_L = j\omega L$. The right-hand side of the equation (5) is given by the following function $y_3$.

$$y_3 = -\frac{\omega L}{Z_0} = -\frac{2\pi f L}{Z_0} \tag{8}$$

In FIG. 21, $y_3$ curves are plotted in the case of using an inductor with a inductance L1, and in the case of using an inductor with an inductance L2 higher than L1.

When the opening of the slit S1 is open, the load impedance $Z_L = \infty$. The right-hand side of the equation (5) is given by the following function $y_4$.

$$y_4 = -\infty \tag{9}$$

An intersection of $y_1$ and $y_2$ or $y_3$ in FIG. 21 represents when the resonance condition of the slit S1 is satisfied, i.e., when the equation (5) is established. In the present example, intersections Q2, Q3, Q4, and Q5 exemplifies only some of the cases in each of which the resonance condition is satisfied. In the case in which the reactance element 15 is capacitive, the increase in the capacitance C changes the resonance condition so as to move from the intersection Q2 toward the intersection Q3, thus decreasing resonant frequency corresponding to the intersection as indicated by the coordinate on a horizontal axis. In the case in which the reactance element 15 is inductive, the decrease in the inductance L changes the resonance condition so as to move from the intersection Q5 toward the intersection Q4, thus increasing the resonant frequency. When the load impedance $Z_L$ is ∞, the resonance condition is determined by the length D1 of the slit S1, and resonance occurs at a frequency that satisfies $\beta \cdot D1 = \pi/2$. In FIG. 21, this is represented by point Q1.

The following table shows a change in resonant frequency (in GHz) versus the reactance value of the reactance element 15 when the length D1 of the slit S1=30 mm and the characteristic impedance $Z_0$=139Ω. In this case, the reactance value is one of a capacitance, a inductance, and no load.

TABLE 2

| Reactance | Frequency |
|---|---|
| 20 pF | 0.30 |
| 10 pF | 0.42 |
| 2 pF | 0.90 |
| 1 pF | 1.21 |
| 0.5 pF | 1.55 |
| 0.1 pF | 2.20 |
| none | 2.50 |
| 50 nH | 2.75 |
| 22 nH | 3.01 |
| 10 nH | 3.42 |
| 4.7 nH | 3.90 |
| 2.7 nH | 4.24 |

According to the above Table 2, it can be seen that the resonant frequency ranges from 0.3 to 4.2 GHz depending on the reactance value. Loading a capacitor to the opening of the slit S1 decreases the resonant frequency, and loading an inductor increases the resonant frequency. Particularly, the resonant frequency is 2.5 GHz when the opening of the slit S1 is open, and this resonant frequency changes to 0.3 GHz when a 20 pF capacitor is used, and changes to 4.2 GHz when a 2.7 nH inductor is used. Accordingly, the resonant frequency can be reduced by loading a capacitive reactance element 15, thus contributing to size reduction of an antenna.

FIG. 22 shows resonant frequency characteristics versus the reactance value of the reactance element 15 for different lengths D1 of the slit S1, including the cases in which the length D1 of the slit S1 is different from 30 mm. It can be seen that the shorter the length D1 of the slit S1 is, the wider the range of the resonant frequency can changes by the reactance value.

EXAMPLE 5

Figure 23:
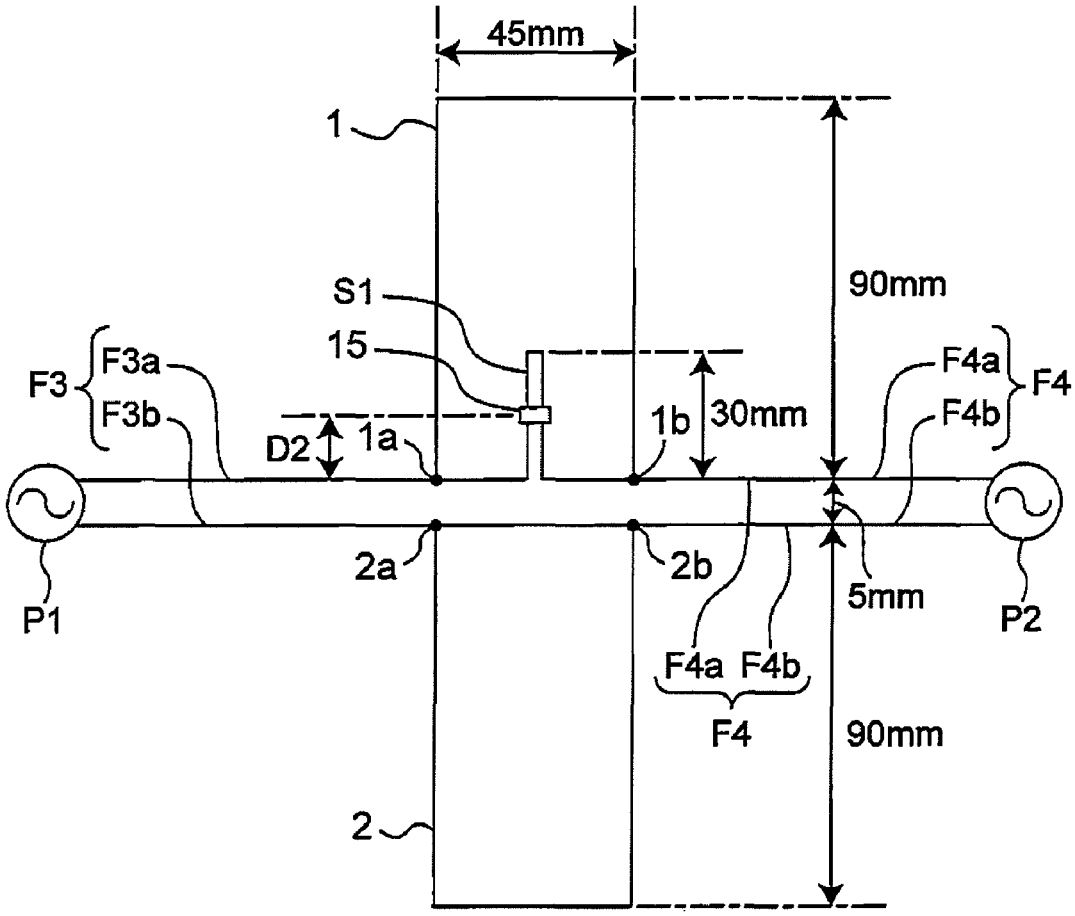
FIG. 23 is a diagram showing a schematic configuration of an antenna apparatus according to Example 5 of the present invention.

FIG. 23 is a diagram showing a schematic configuration of an antenna apparatus according to Example 5 of the present invention. The antenna apparatus of the present example also corresponds to an antenna apparatus of the sixth preferred embodiment, as in the case of an antenna apparatus of Example 4. A simulation of the present example shows that the resonant frequency of an antenna element 1 and the isolation frequency change depending on a distance D2 of a reactance element 15 from an opening of a slit S1.

Referring to FIG. 23, the antenna element 1 and a ground conductor 2 have the same configuration as that of Example 2 (see FIG. 12), and the length of the slit S1 is fixed at 30 mm. Furthermore, the reactance element 15 is provided at a position with the distance D2 from the opening of the slit S1. A change in the frequency characteristic of the antenna apparatus is examined when changing the position of providing the reactance 15 (i.e., the distance D2 from the opening).

Figure 24:
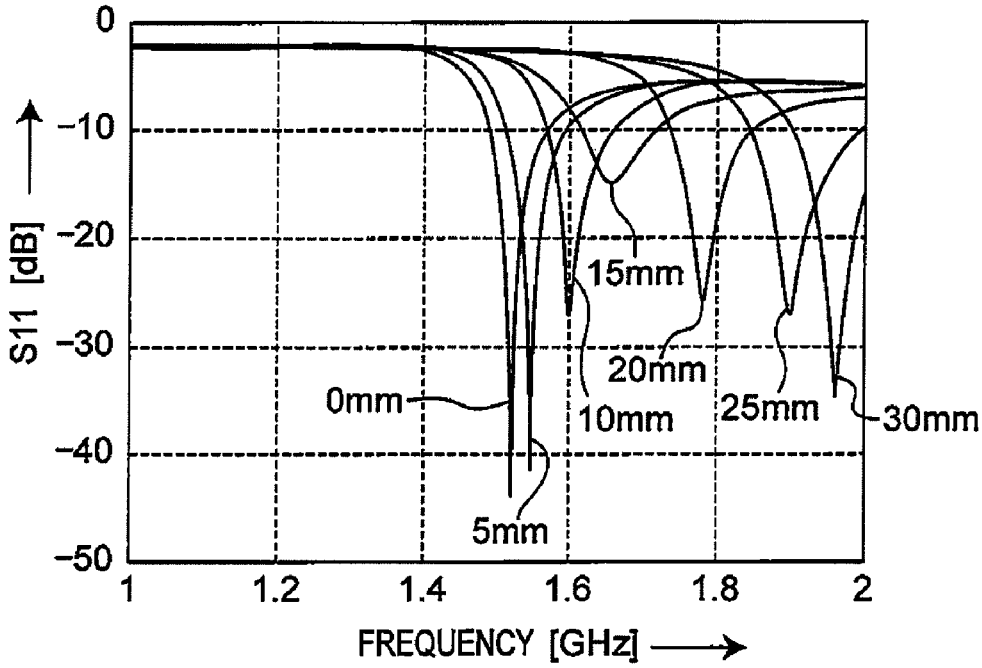
FIG. 24 is a graph showing a reflection coefficient parameter S11 versus frequency for different positions of a reactance element 15 in the antenna apparatus of FIG. 23 when the reactance value of the reactance element 15 is 0.5 pF.
Figure 25:
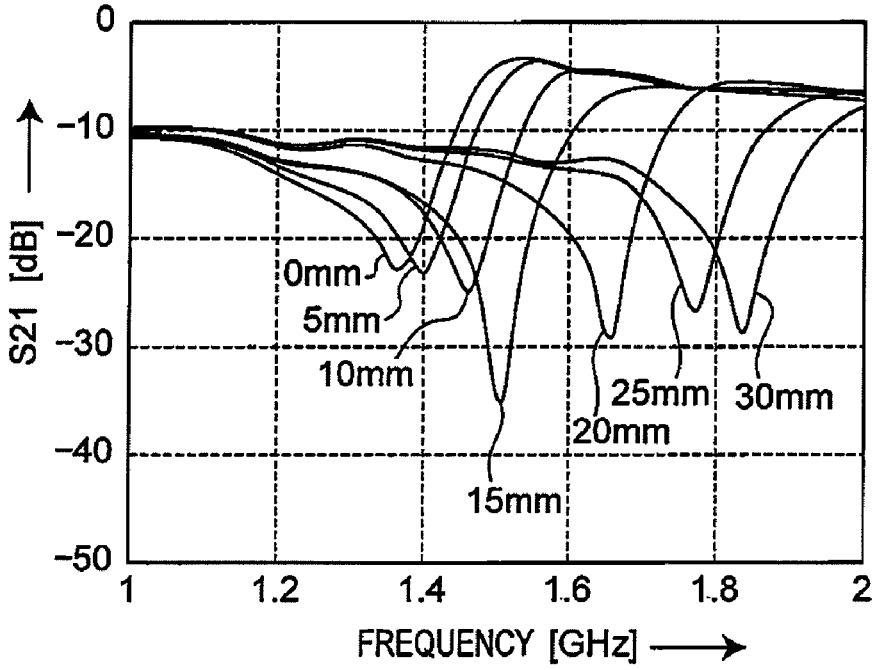
FIG. 25 is a graph showing a transmission coefficient parameter S21 versus frequency for different positions of the reactance element 15 in the antenna apparatus of FIG. 23 when the reactance value of the reactance element 15 is 0.5 pF.
Figure 26:
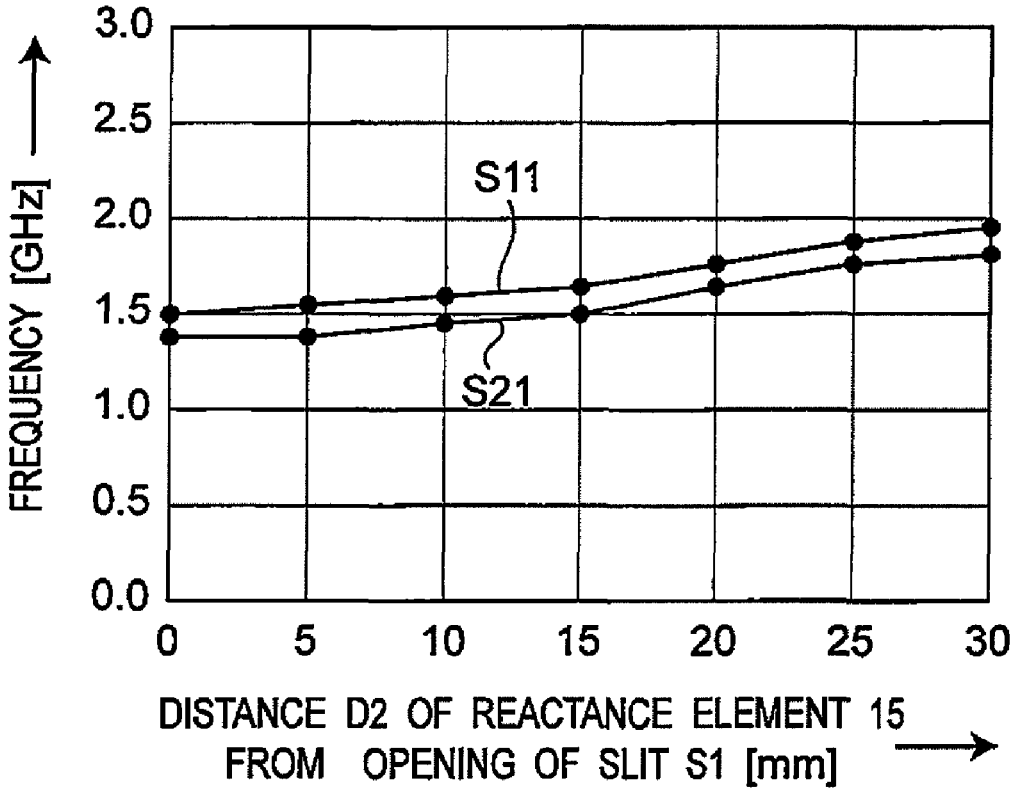
FIG. 26 is a graph showing frequency characteristics versus the position of the reactance element 15 in the antenna apparatus of FIG. 23 when the reactance value of the reactance element 15 is 0.5 pF.

FIGS. 24 to 26 show simulation results obtained when the reactance value of the reactance element 15 is 0.5 pF in the antenna apparatus of FIG. 23. FIG. 24 is a graph showing a reflection coefficient parameter S11 versus frequency for different positions of the reactance element 15. FIG. 25 is a graph showing a transmission coefficient parameter S21 versus frequency for different positions of the reactance element 15. FIG. 26 is a graph showing frequency characteristics versus the position of the reactance element 15, and shows the relationship between a change in the resonant frequency of the antenna element 1 (i.e., S11) and a change in isolation frequency (i.e., S21) when changing the position of the reactance element 15.

Figure 27:
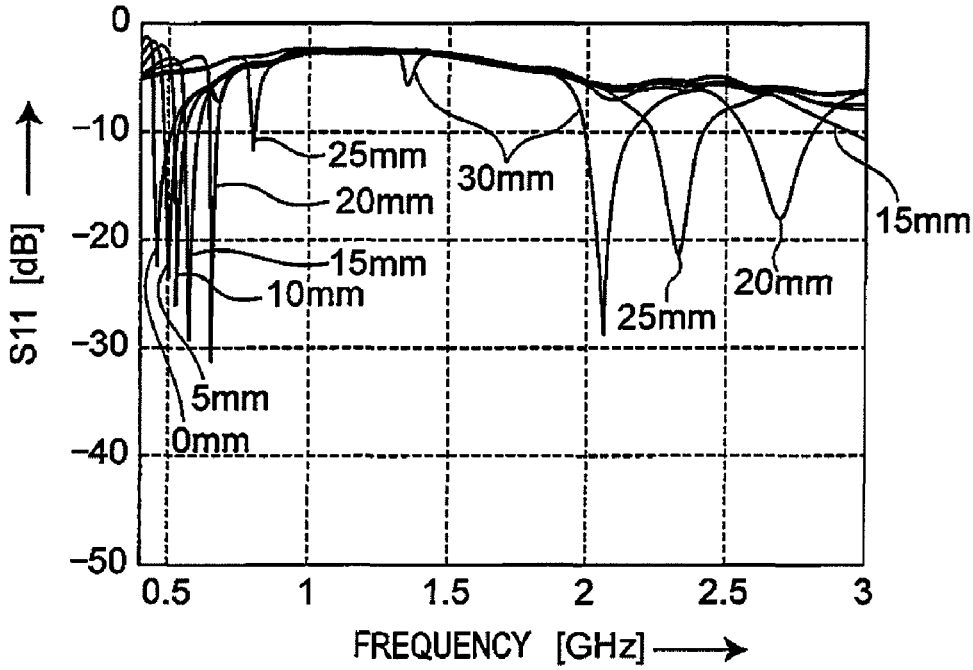
FIG. 27 is a graph showing the a reflection coefficient parameter S11 versus frequency for different positions of the reactance element 15 in the antenna apparatus of FIG. 23 when the reactance value of the reactance element 15 is 10 pF.
Figure 28:
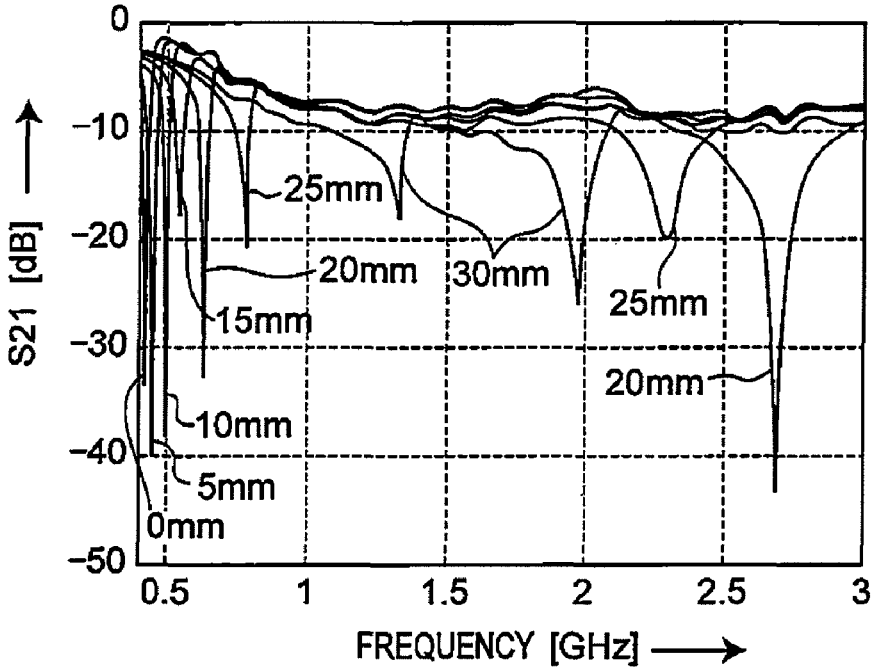
FIG. 28 is a graph showing the a transmission coefficient parameter S21 versus frequency for different positions of the reactance element 15 in the antenna apparatus of FIG. 23 when the reactance value of the reactance element 15 is 10 pF.
Figure 29:
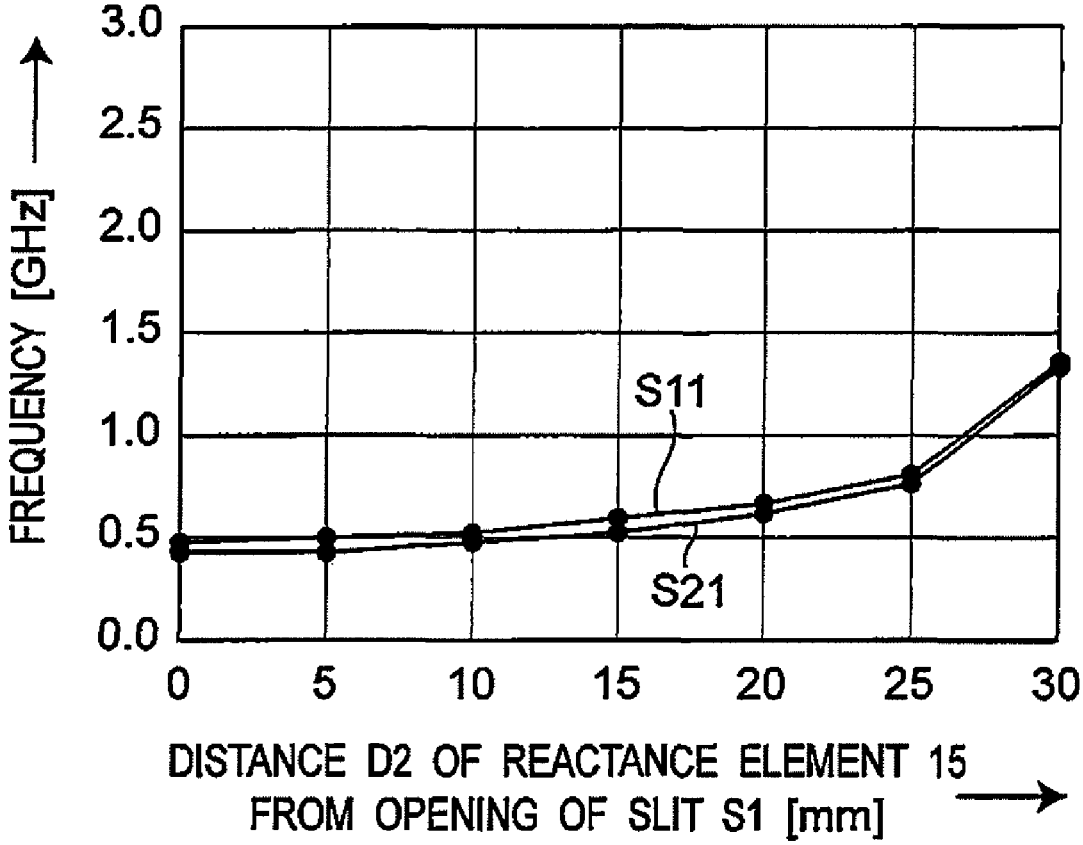
FIG. 29 is a graph showing frequency characteristics versus the position of the reactance element 15 in the antenna apparatus of FIG. 23 when the reactance value of the reactance element 15 is 10 pF.

FIGS. 27 to 29 show simulation results obtained when the reactance value of the reactance element 15 is 10 pF in the antenna apparatus of FIG. 23. FIG. 27 is a graph showing a reflection coefficient parameter S11 versus frequency for different positions of the reactance element 15. FIG. 28 is a graph showing a transmission coefficient parameter S21 versus frequency for different positions of the reactance element 15. FIG. 29 is a graph showing frequency characteristics versus the position of the reactance element 15, and shows the relationship between a change in the resonant frequency of the antenna element 1 and a change in isolation frequency when changing the position of the reactance element 15.

Figure 30:
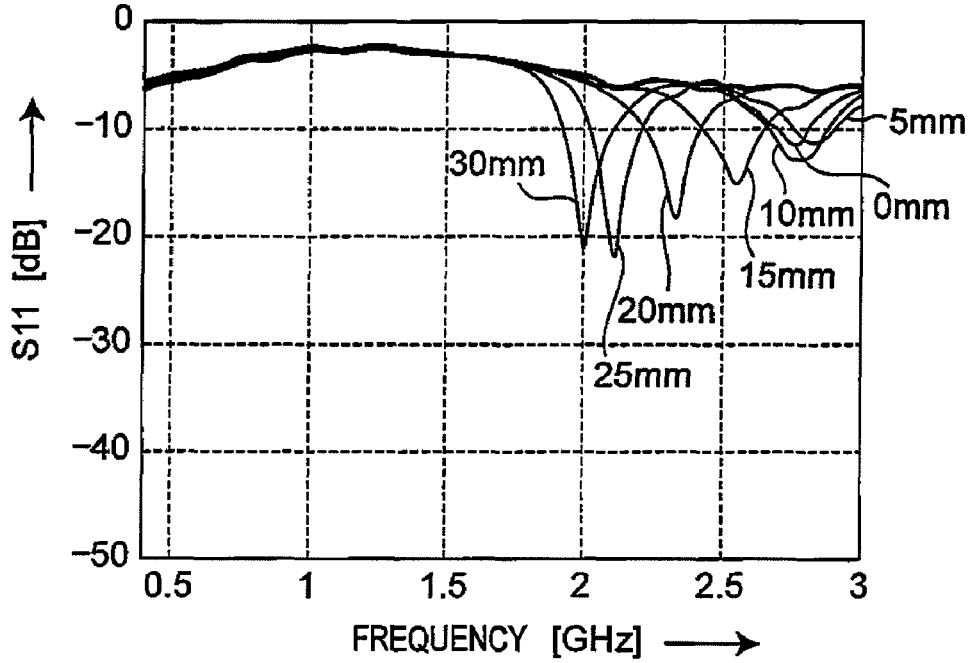
FIG. 30 is a graph showing the a reflection coefficient parameter S11 versus frequency for different positions of the reactance element 15 in the antenna apparatus of FIG. 23 when the reactance value of the reactance element 15 is 4.7 nH.
Figure 31:
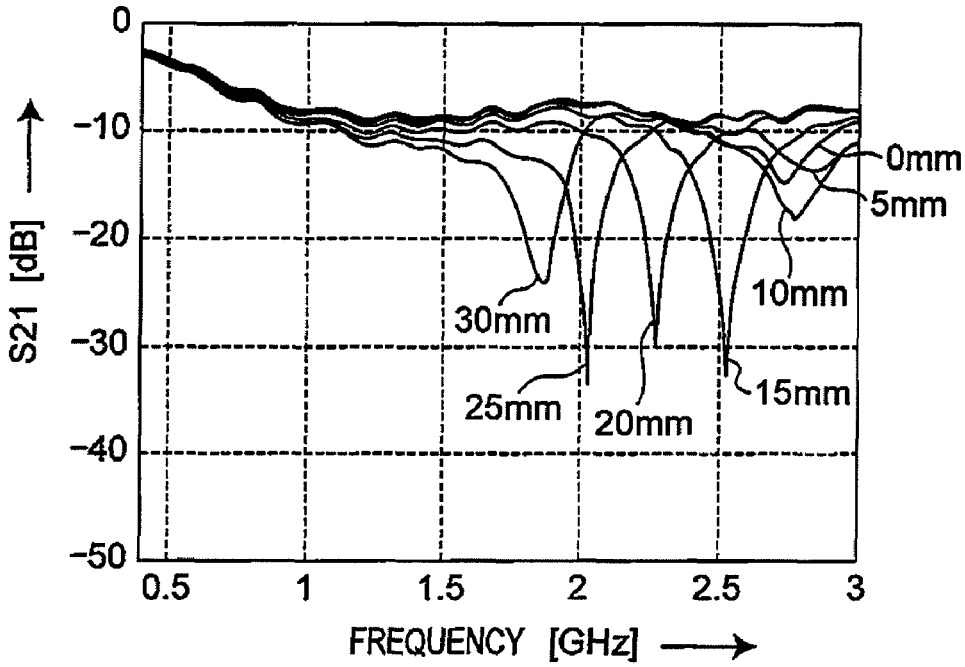
FIG. 31 is a graph showing the a transmission coefficient parameter S21 versus frequency for different positions of the reactance element 15 in the antenna apparatus of FIG. 23 when the reactance value of the reactance element 15 is 4.7 nH.
Figure 32:
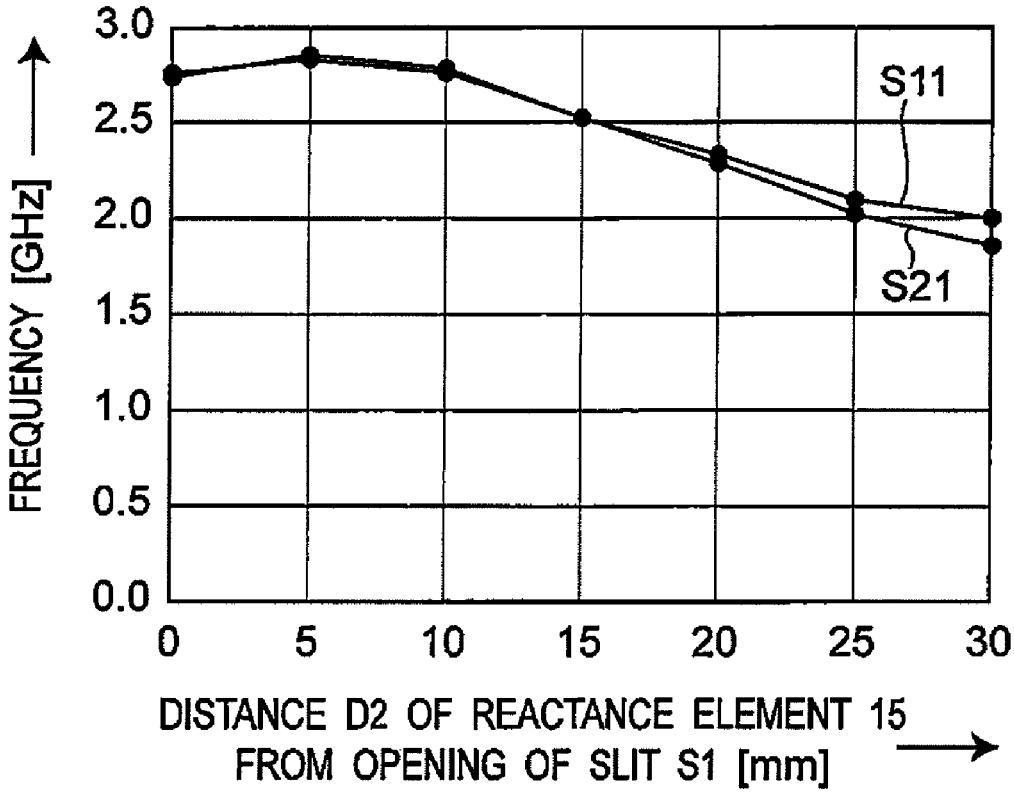
FIG. 32 is a graph showing frequency characteristics versus the position of the reactance element 15 in the antenna apparatus of FIG. 23 when the reactance value of the reactance element 15 is 4.7 nH.

FIGS. 30 to 32 show simulation results obtained when the reactance value of the reactance element 15 is 4.7 nH in the antenna apparatus of FIG. 23. FIG. 30 is a graph showing a reflection coefficient parameter S11 versus frequency for different positions of the reactance element 15. FIG. 31 is a graph showing a transmission coefficient parameter S21 versus frequency for different positions of the reactance element 15. FIG. 32 is a graph showing frequency characteristics versus the position of the reactance element 15, and shows the relationship between a change in the resonant frequency of the antenna element 1 and a change in isolation frequency when changing the position of the reactance element 15.

Referring to FIGS. 24 to 32, it can be seen that the resonant frequency of the antenna element 1 and the isolation frequency change depending on the position of providing the reactance element 15. It can be seen that when using a capacitive reactance element 15 with a capacitance of 0.5 pF, the variation for S11 ranges from 1.5 to 1.9 GHz, and the variation for S21 ranges from 1.4 to 1.8 GHz, thus producing a frequency shift over 400 MHz. When using a capacitive reactance element 15 with a capacitance of 10 pF, and when using an inductive reactance element 15 with an inductance of 4.5 nH, the frequency changes are substantially the same for S11 and S21. It can be seen that in the case of 10 pF, a frequency shift over 900 MHz from 0.4 to 1.3 GHz is produced, and in the case of 4.5 nH, a frequency shift over 800 MHz from 2.8 to 2.0 GHz is produced. It has been found that when a capacitor is used as the reactance element 15, the resonant frequency tends to increase by increasing the distance D2 of the reactance element 15 from the opening of the slit S1; on the other hand, when an inductor is used as the reactance element 15, the resonant frequency tends to decrease by increasing the distance D2.

EXAMPLE 6

Figure 33:
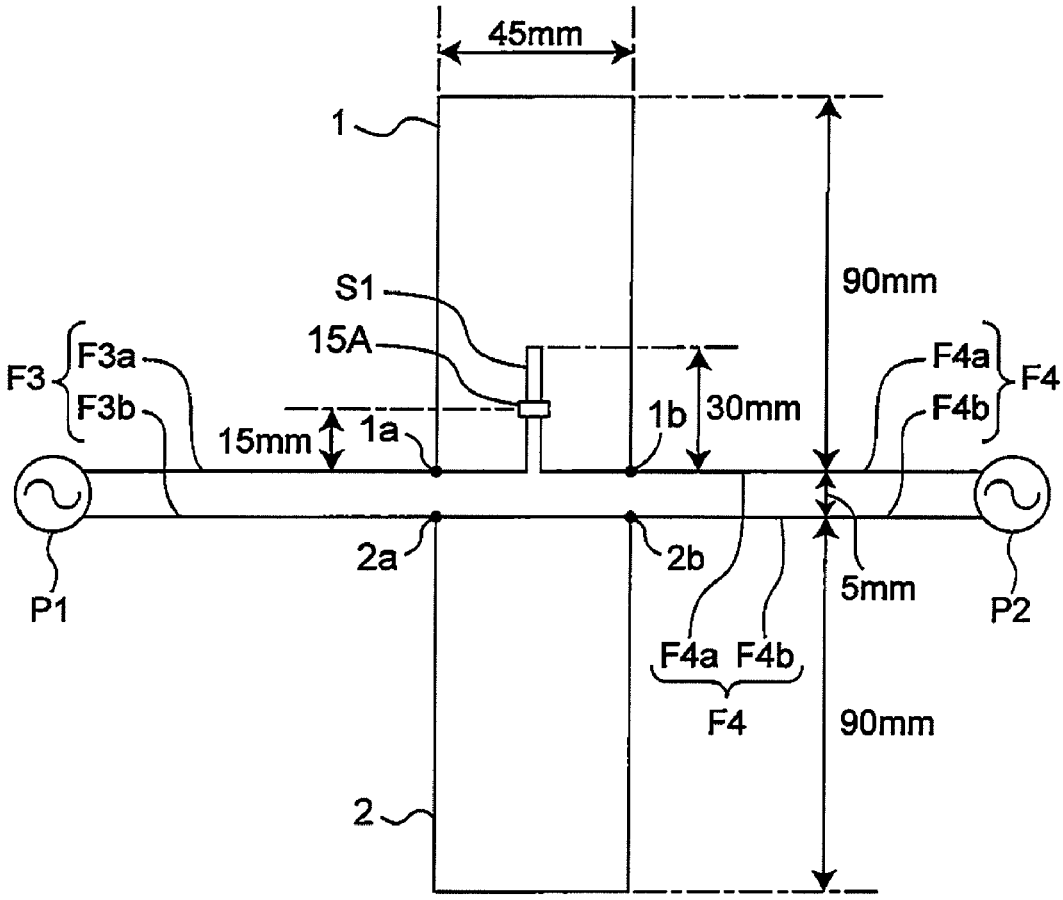
FIG. 33 is a diagram showing a schematic configuration of an antenna apparatus according to Example 6 of the present invention.

FIG. 33 is a diagram showing a schematic configuration of an antenna apparatus according to Example 6 of the present invention. The antenna apparatus of the present example corresponds to an antenna apparatus of the seventh preferred embodiment. A simulation of the present example shows that the resonant frequency of an antenna element 1 and the isolation frequency change depending on the reactance value of a variable reactance element 15A.

Referring to FIG. 33, the antenna element 1 and a ground conductor 2 have the same configuration as that of Example 5 (see FIG. 23), and the variable reactance element 15A is fixed at a position with 15 mm from an opening of a slit S1. Components such as a controller 13A of FIG. 7 are not shown.

Figure 34:
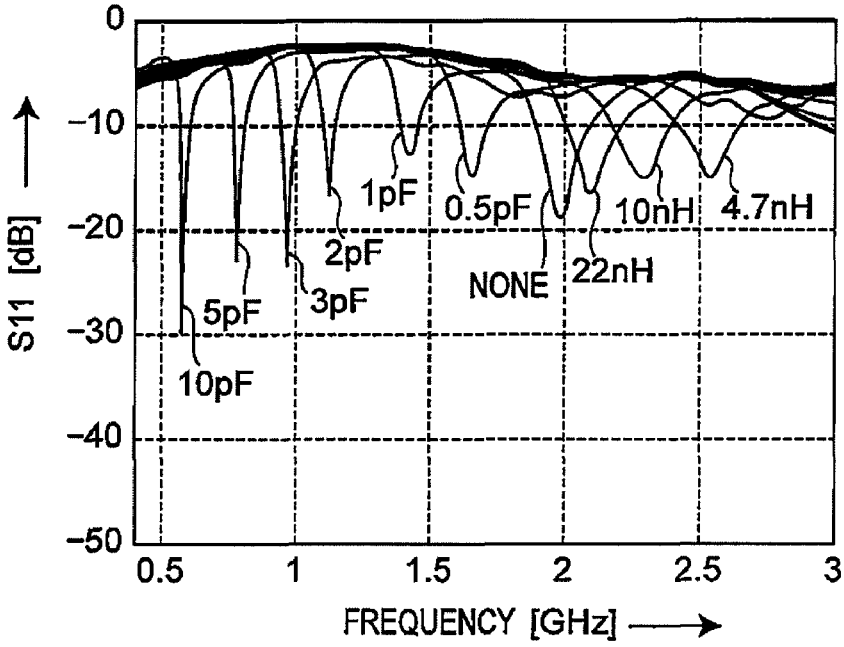
FIG. 34 is a graph showing a reflection coefficient parameter S11 versus frequency for different reactance values of a variable reactance element 15A in the antenna apparatus of FIG. 33.
Figure 35:
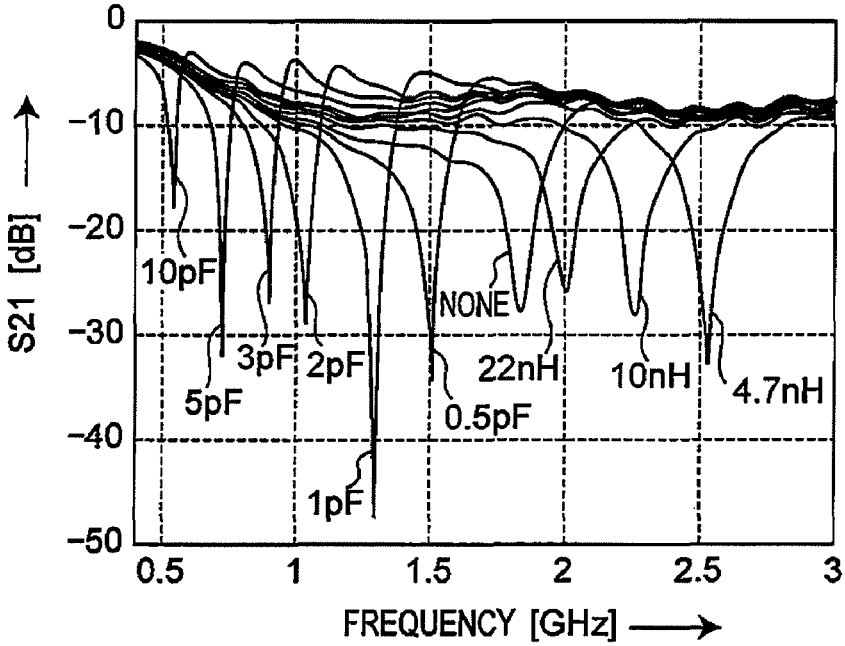
FIG. 35 is a graph showing a transmission coefficient parameter 521 versus frequency for different reactance values of the variable reactance element 15A in the antenna apparatus of FIG. 33.

FIG. 34 is a graph showing a reflection coefficient parameter S11 versus frequency for different reactance values of the variable reactance element 15A in the antenna apparatus of FIG. 33. FIG. 35 is a graph showing a transmission coefficient parameter S21 versus frequency for different reactance values of the variable reactance element 15A in the antenna apparatus of FIG. 33. According to FIG. 34, it can be seen that when the variable reactance element 15A is capacitive, the higher the capacitance C, the lower the resonant frequency; and when the variable reactance element 15A is inductive, the lower the inductance L, the higher the resonant frequency. According to FIG. 35, it can be seen that the isolation frequency changes in the similar manner as the resonant frequency, and ranges from 600 MHz to 2.5 GHz. The lower limit of the reactance value used in simulations of FIGS. 34 and 35 is 10 pF and, the upper limit is 4.7 nH. It is expected that a wider frequency shift can be achieved by using a wider range of changing the reactance value.

The following table shows the relationship between a change in the resonant frequency of the antenna element 1 (in GHz) and a change in isolation frequency (in GHz) when changing the reactance value of the variable reactance element 15A.

TABLE 3

| | S11 | S21 |
|---|---|---|
| 10 pF | 0.579 | 0.544 |
| 5 pF | 0.787 | 0.738 |
| 3 pF | 0.972 | 0.903 |
| 2 pF | 1.130 | 1.045 |
| 1 pF | 1.424 | 1.299 |
| 0.5 pF | 1.659 | 1.512 |
| none | 1.988 | 1.837 |
| 22 nH | 2.090 | 2.010 |
| 10 nH | 2.311 | 2.262 |
| 4.7 nH | 2.539 | 2.526 |

Figure 36:
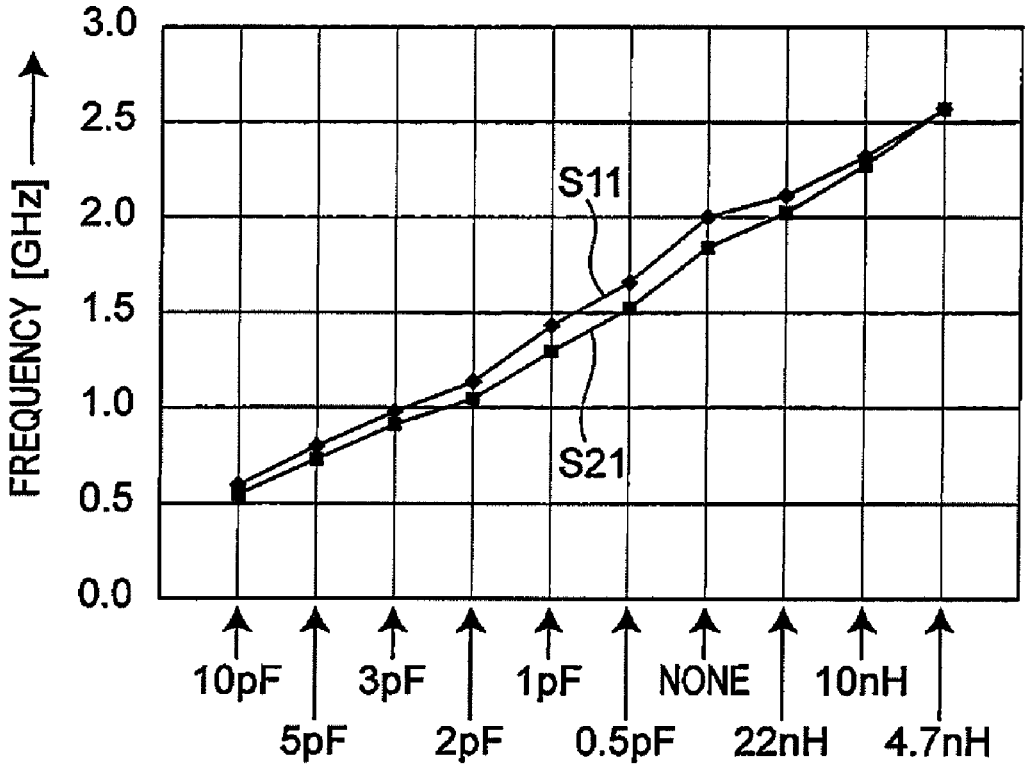
FIG. 36 is a graph showing frequency characteristics versus the reactance value of the variable reactance element 15A in the antenna apparatus of FIG. 33.

The relationship shown in the above Table 3 is also shown in a graph of FIG. 36. FIG. 36 is a graph showing frequency characteristics versus the reactance value of the variable reactance element 15A in the antenna apparatus of FIG. 33. According to Table 3 and FIG. 36, it can be seen that when the antenna apparatus of the present example is configured without the variable reactance element 15A, S11 and S21 have different ratios of a frequency change to a reactance change, but when using a frequency shift by the reactance value of the variable reactance element 15A, the frequency difference between S11 and S21 is reduced.

EXAMPLE 7

Figure 37A:
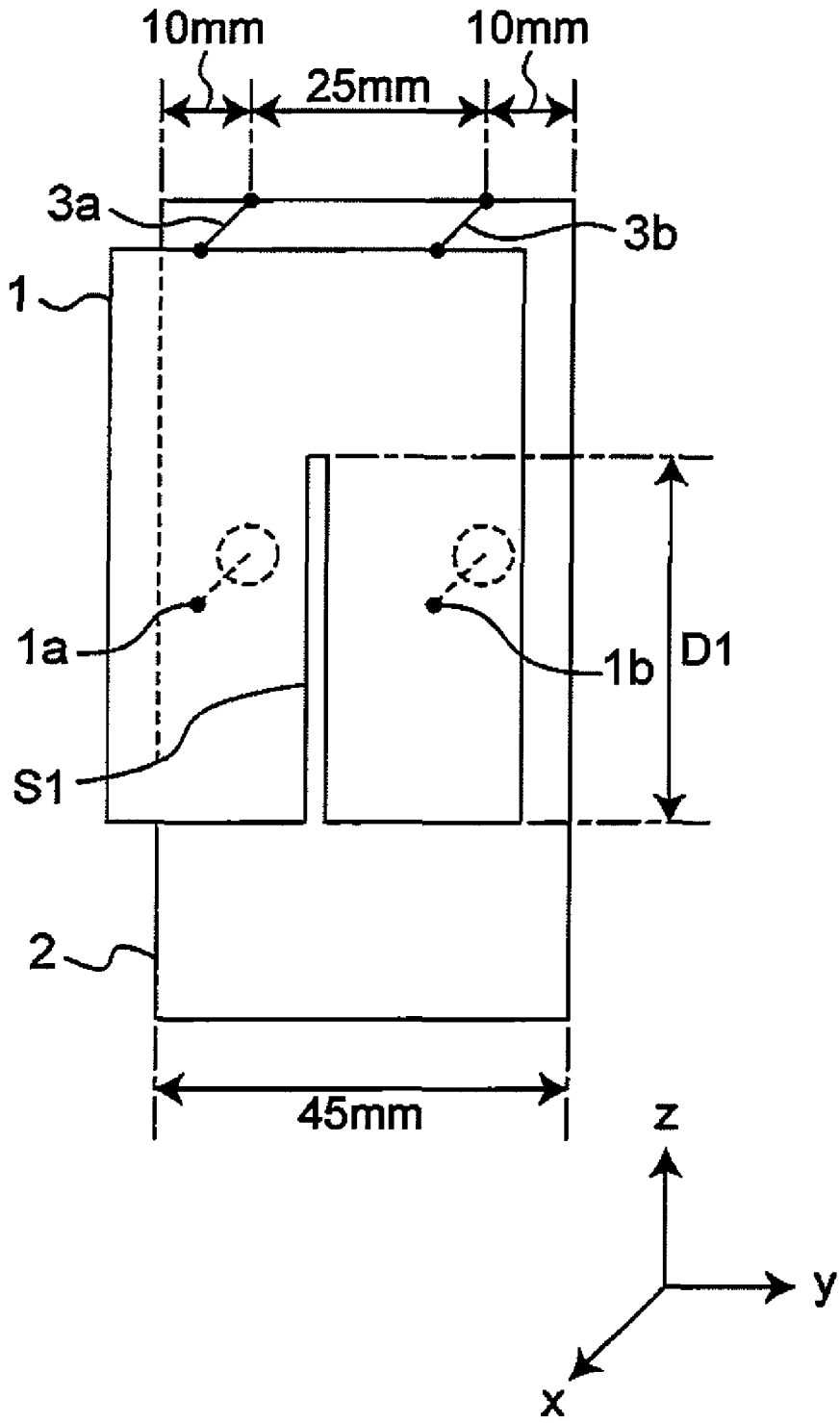
FIG. 37A is a perspective view showing a schematic configuration of an antenna apparatus according to Example 7 of the present invention.
Figure 37B:
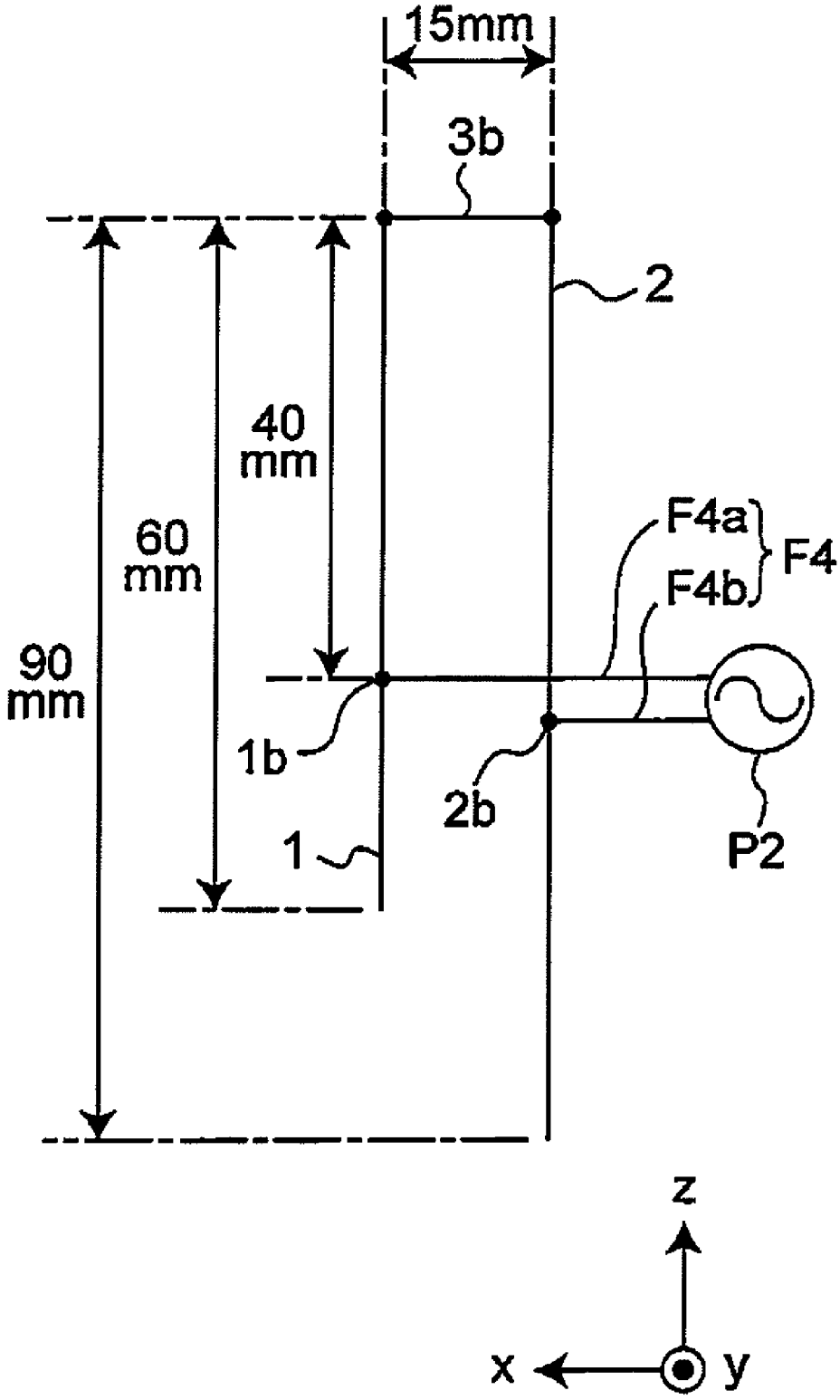
FIG. 37B is a side view of the antenna apparatus of FIG. 37A.

FIG. 37A is a perspective view showing a schematic configuration of an antenna apparatus according to Example 7 of the present invention, and FIG. 37B is a side view of the antenna apparatus. The antenna apparatus of the present example corresponds to an antenna apparatus of the ninth preferred embodiment. A simulation of the present example shows that the resonant frequency of an antenna element 1 and the isolation frequency change depending on a length D1 of a slit S1.

Referring to FIGS. 37A and 37B, the antenna apparatus has the same configuration as that of the ninth preferred embodiment (see FIG. 9). In the present example, the positions of feed points 1*a* and 1*b* are moved in a −Z direction as compared to the other examples, in order to increase the effect of the slit S1.

Figure 38:
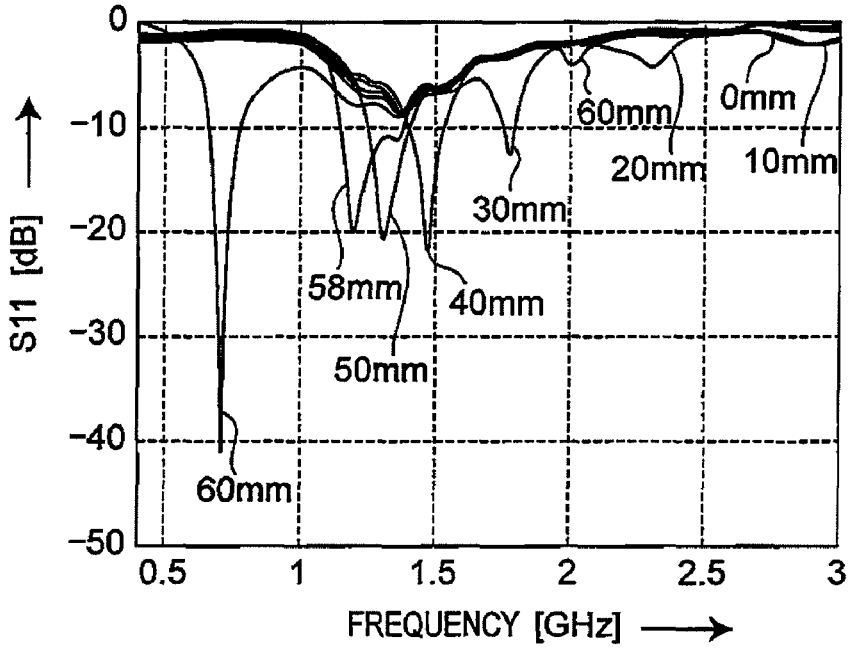
FIG. 38 is a graph showing a reflection coefficient parameter S11 versus frequency for different lengths D1 of a slit S1 in the antenna apparatus of FIGS. 37A and 37B.
Figure 39:
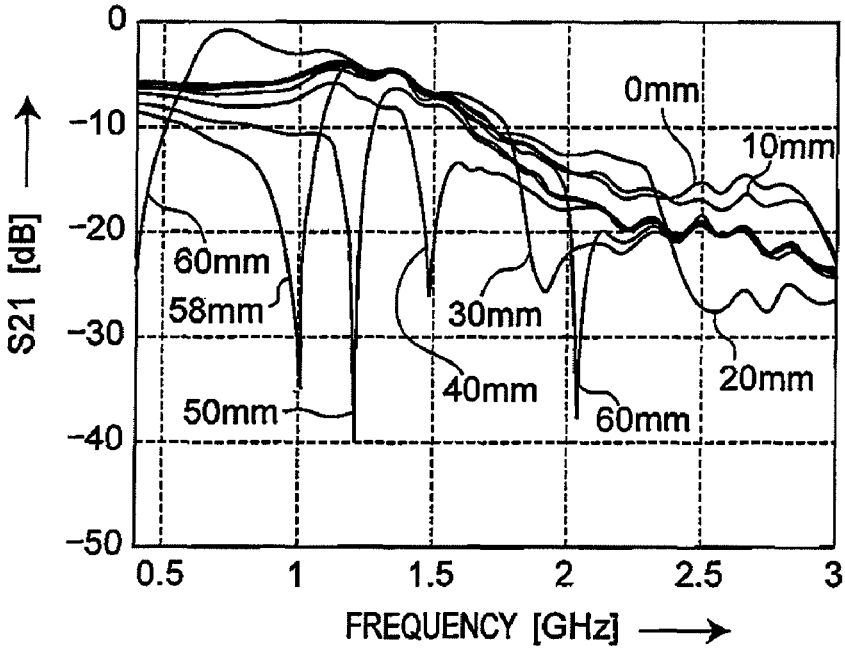
FIG. 39 is a graph showing a transmission coefficient parameter S21 versus frequency for different lengths D1 of the slit S1 in the antenna apparatus of FIGS. 37A and 37B.

FIG. 38 is a graph showing a reflection coefficient parameter S11 versus frequency for different lengths D1 of the slit S1 in the antenna apparatus of FIGS. 37A and 37B. FIG. 39 is a graph showing a transmission coefficient parameter S21 versus frequency for different lengths D1 of the slit S1 in the antenna apparatus of FIGS. 37A and 37B.

The following table shows the relationship between a change in the resonant frequency of the antenna element 1 (in GHz) and a change in the isolation frequency (in GHz) when changing the length D1 of the slit S1 (in mm).

TABLE 4

| D1 | S11 | S21 |
|---|---|---|
| 15 | 2.478 | 2.573 |
| 20 | 2.290 | 2.534 |
| 30 | 1.773 | 1.895 |
| 40 | 1.469 | 1.479 |
| 50 | 1.305 | 1.198 |
| 58 | 1.190 | 0.989 |

Figure 40:
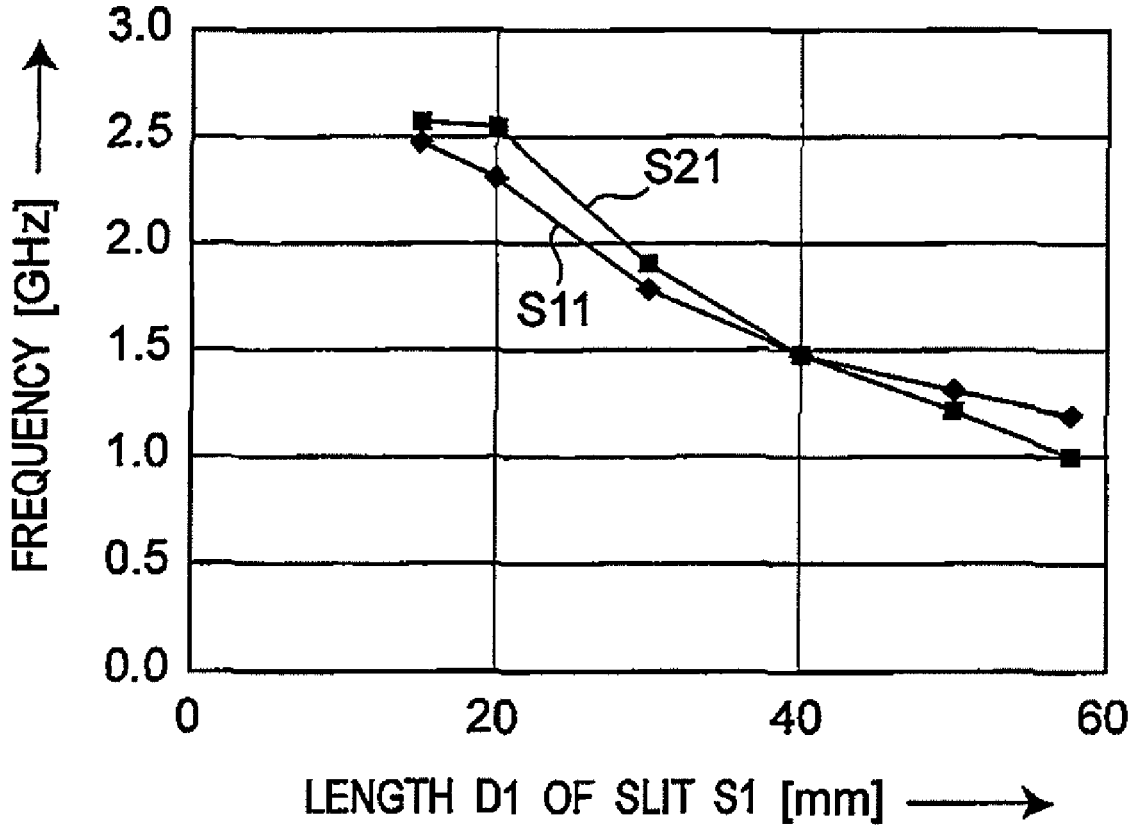
FIG. 40 is a graph showing frequency characteristics versus the length D1 of the slit S1 in the antenna apparatus of FIGS. 37A and 37B.

The relationship shown in the above Table 4 is also shown in a graph of FIG. 40. FIG. 40 is a graph showing frequency characteristics versus the length D1 of the slit S1 in the antenna apparatus of FIGS. 37A and 37B. According to Table 4 and FIG. 40, it can be seen that the resonant frequency range from 1.19 GHz to 2.478 GHz, and the isolation frequency ranges from 0.989 GHz to 2.573 GHz. When the length D1 of the slit S1=40 mm, S11 and S21 are −10 dB or less in a frequency range of 1.399 to 1.525 [GHz], with the bandwidth of 0.125 [GHz].

MODIFIED PREFERRED EMBODIMENT

The shapes of an antenna element 1 and a ground conductor 2 are not limited to rectangular, and may be other shapes, e.g., polygons, circles, or ellipses. Further, an antenna apparatus can be configured as a combination of preferred embodiments. For example, a trap circuit 14 of the fifth preferred embodiment may be provided on at least one slit of one of antenna apparatuses of the second to fourth preferred embodiments. Further, for example, a reactance element 15 of the sixth preferred embodiment or a variable reactance element 15A of the seventh preferred embodiment may be provided on at least one slit of one of antenna apparatuses of the second to fourth preferred embodiments. In this case, a plurality of resonant frequencies can be adjusted by the slit length, by the reactance value of a reactance element, and by the position of providing the reactance element, thus increasing flexibility in frequency adjustment. Furthermore, instead of MIMO communication circuits 10 and 10A, a wireless communication circuit for modulating and demodulating two independent radio signals may be provided. In this case, an antenna apparatus of the present preferred embodiment can simultaneously perform wireless communications for multiple applications, and can simultaneously perform wireless communications in multiple frequency bands.

INDUSTRIAL APPLICABILITY

Antenna apparatuses and wireless apparatuses using the antenna apparatuses according to the present invention can be implemented as, e.g., mobile phones, or wireless LAN apparatuses. The antenna apparatuses can be mounted on wireless communication apparatuses for performing, e.g., MIMO communication. In addition to MIMO, the antenna apparatuses can also be mounted on wireless communication apparatuses capable of simultaneously performing communications for multiple applications.

REFERENCE SIGNS LIST

1: antenna element,
1*a*, 1*b*: feed point,
2*a*, 2*b*: connection point,
2: ground conductor,
3*a*, 3*b*: connecting conductor,
10, 10A: MIMO communication circuit,
11, 12, 11A, 12A: impedance matching circuit,
11*a*, 12*a*: inductor,
13, 13A: controller,
14: trap circuit,
15: reactance element,
15A: variable reactance element,
S1, S2, S3: slit,
S4: slot,
F1, F2, F3, F4: feed line,
F3*a*, F3*b*, F4*a*, F4*b*: signal line, and
P1, P2: signal source.

The invention claimed is:

1. An antenna apparatus comprising a first and a second feed ports respectively provided at positions on an antenna element, the antenna element being simultaneously excited through the first and the second feed ports so as to simultaneously operate as a first and a second antenna portions respectively associated with the first and the second feed ports, wherein the antenna apparatus further comprises:

an electromagnetic coupling adjuster provided between the first and the second feed ports, the electromagnetic coupling adjuster changing a resonant frequency of the antenna element and producing isolation between the first and the second feed ports at a isolation frequency; and impedance matching circuits for shifting an operating frequency of the antenna element from the changed resonant frequency to the isolation frequency.

2. The antenna apparatus as claimed in claim 1, wherein the electromagnetic coupling adjuster is at least one slit provided on the antenna element.

3. The antenna apparatus as claimed in claim 1, wherein the antenna apparatus includes a first antenna element and a second antenna element, wherein the first feed port is provided at a first position where the first antenna elements is opposed to the second antenna elements, wherein the second feed port is provided at a second position which is different from the first position and where the first antenna elements is opposed to the second antenna elements, and wherein the electromagnetic coupling adjuster is at least one slit provided on at least one of the first and the second antenna elements.

4. The antenna apparatus as claimed in claim 2, further comprising a trap circuit provided at a position along one of the slits, with a distance from an opening of the slit, wherein the trap circuit is open and makes the entire slit resonate at a first frequency, and the trap circuit makes only a section of the slit from the opening to the trap circuit resonate at frequencies deviated from the first frequency.

5. The antenna apparatus as claimed in claim 2, further comprising a reactance element provided on at least one of the slits, the reactance element changing the resonant frequency and the isolation frequency.

6. The antenna apparatus as claimed in claim 2, further comprising:

a variable reactance element provided on at least one of the slits; and a controller for changing a reactance value of the variable reactance element to change the resonant frequency and the isolation frequency.

7. The antenna apparatus as claimed in claim 1, wherein the electromagnetic coupling adjuster is at least one slot provided on the antenna element.

8. The antenna apparatus as claimed in claim 1, wherein the antenna element is configured as a planar inverted-F antenna element on a ground conductor.

9. A wireless communication apparatus transmitting and receiving multiple radio signals, the wireless communication apparatus comprising an antenna apparatus, wherein the antenna apparatus comprising a first and a second feed ports respectively provided at positions on an antenna element, the antenna element being simultaneously excited through the first and the second feed ports so as to simultaneously operate as a first and a second antenna portions respectively associated with the first and the second feed ports, wherein the antenna apparatus further comprises:

an electromagnetic coupling adjuster provided between the first and the second feed ports, the electromagnetic coupling adjuster changing a resonant frequency of the antenna element and producing isolation between the first and the second feed ports at a isolation frequency; and impedance matching circuits for shifting an operating frequency of the antenna element from the changed resonant frequency to the isolation frequency.

* * * * *